US008478165B2

(12) United States Patent
Somemiya et al.

(10) Patent No.: US 8,478,165 B2
(45) Date of Patent: Jul. 2, 2013

(54) IMAGE FORMING APPARATUS HAVING AN OPENABLE MEMBER

(75) Inventors: Tsutomu Somemiya, Saitama (JP); Ryotaro Nomi, Saitama (JP)

(73) Assignee: FUJI XEROX Co., Ltd., Tokyo (JP)

( * ) Notice: Subject to any disclaimer, the term of this patent is extended or adjusted under 35 U.S.C. 154(b) by 692 days.

(21) Appl. No.: 12/652,906

(22) Filed: Jan. 6, 2010

(65) Prior Publication Data

US 2010/0278557 A1 Nov. 4, 2010

(30) Foreign Application Priority Data

May 1, 2009 (JP) ..... 2009-111916

(51) Int. Cl.
*G03G 21/00* (2006.01)

(52) U.S. Cl.
USPC ..... 399/124

(58) Field of Classification Search
USPC ..... 399/107, 110, 121, 124
See application file for complete search history.

(56) References Cited

U.S. PATENT DOCUMENTS

| | | | | |
|---|---|---|---|---|
| 5,606,406 | A | 2/1997 | Ikeyama | |
| 2006/0093397 | A1 * | 5/2006 | Yamaoka | 399/110 |
| 2007/0092292 | A1 * | 4/2007 | Ito | 399/124 |
| 2007/0212108 | A1 * | 9/2007 | Hozono et al. | 399/121 |

FOREIGN PATENT DOCUMENTS

| | | | |
|---|---|---|---|
| JP | 04-066963 | A | 3/1992 |
| JP | 06-110264 | A | 4/1994 |
| JP | 11-190966 | A | 7/1999 |
| JP | 2003162104 | A | 6/2003 |
| JP | 2004240329 | A | 8/2004 |
| JP | 2005-172856 | A | 6/2005 |

OTHER PUBLICATIONS

Japanese Office Action dated Apr. 17, 2012 issued in counterpart Japanese Application No. 2009111916.
Translation of Japanese Office Action issued in Japanese Application No. 2012-135476 dated Jul. 24, 2012.

* cited by examiner

*Primary Examiner* — Walter L Lindsay, Jr.
*Assistant Examiner* — Milton Gonzalez
(74) *Attorney, Agent, or Firm* — Sughrue Mion, PLLC

(57) ABSTRACT

An image forming apparatus includes: an image forming apparatus body; an openable member that is supported movably between an opening position and a closing position; a positioning portion that is provided in the image forming apparatus body; a positioned portion that is supported on the openable member and that is brought into contact with the positioning portion to be positioned when the openable member is in the closing position; a rotary member that is supported on the image forming apparatus body; and an opposed member that is supported on the openable member. When the openable member moves to the closing position, the opposed member moves in a direction crossing an opening/closing direction of the openable member and then moves in a reverse direction to the moving direction. And the opposed member is opposed to the rotary member rotatably when the openable member is in the closing position.

7 Claims, 20 Drawing Sheets

IMAGE FORMING APPARATUS HAVING AN OPENABLE MEMBER

CROSS-REFERENCE TO RELATED APPLICATIONS

This application is based on and claims priority under 35 USC 119 from Japanese Patent Application No. 2009-111916 filed on May 1, 2009.

BACKGROUND

1. Technical Field

The present invention relates to an image forming apparatus.

2. Related Art

In an image forming apparatus such as a copying machine or a printer according to the related art, a so-called openable cover which is an openable member capable of revealing the inside of the image forming apparatus is provided so that a paper jam of a medium conveyed to form an image thereon can be solved or an exhausted part can be replaced.

SUMMARY

According to an aspect of the invention, an image forming apparatus includes: an image forming apparatus body; an openable member that is supported movably between an opening position where the openable member is opened to reveal an inside of the image forming apparatus body and a closing position where the openable member is closed to hide the inside of the image forming apparatus body; a positioning portion that is provided in the image forming apparatus body; a positioned portion that is supported on the openable member and that is brought into contact with the positioning portion to be positioned when the openable member is in the closing position; a rotary member that is supported on the image forming apparatus body; and an opposed member that is supported on the openable member. When the openable member moves to the closing position, the opposed member moves in a direction crossing an opening/closing direction of the openable member and then moves in a reverse direction to the moving direction. The opposed member is opposed to the rotary member rotatably when the openable member is in the closing position.

BRIEF DESCRIPTION OF THE DRAWINGS

Exemplary embodiment(s) of the present invention will be described in detail based on the following figures, wherein.

DETAILED DESCRIPTION

Figure 1:
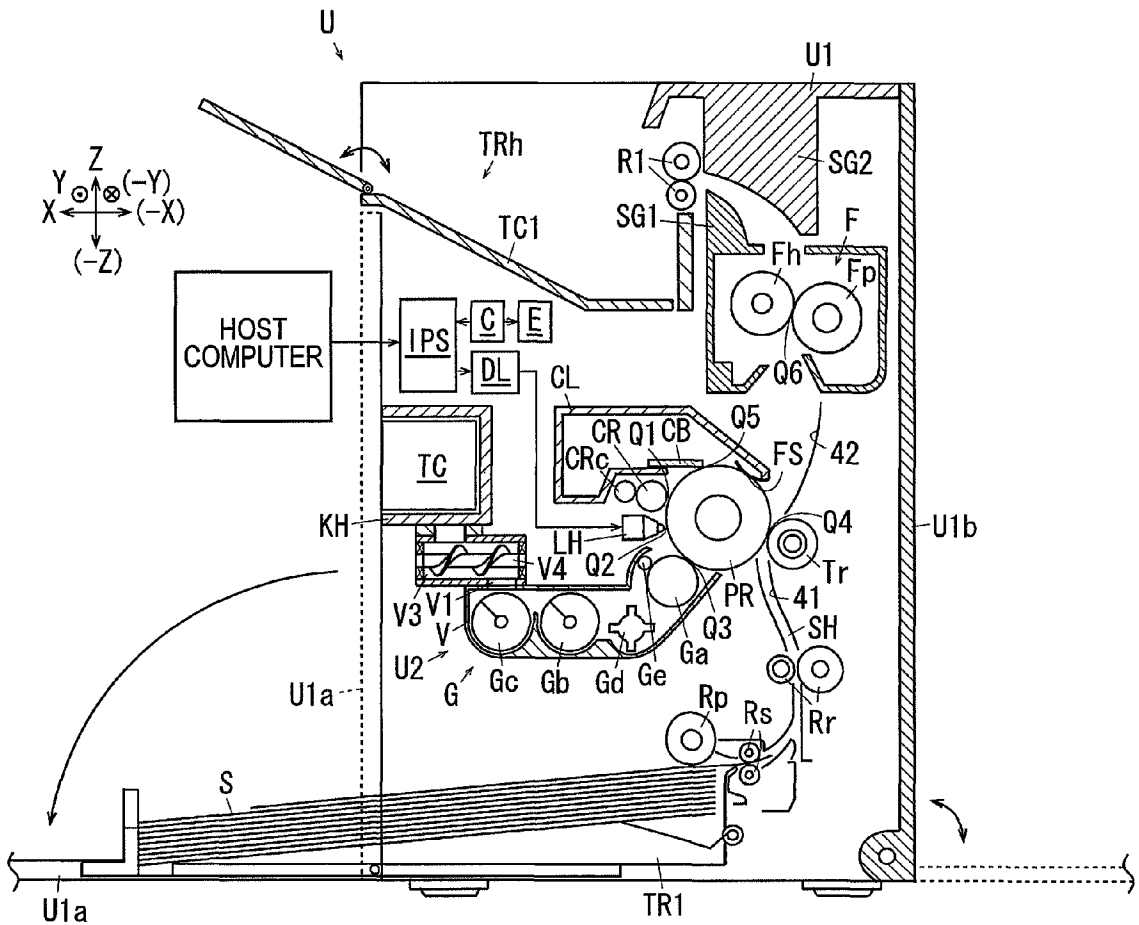
FIG. 1 is a general view for explaining an image forming apparatus according to a first exemplary embodiment.

Although specific examples of modes for carrying out the invention (hereinafter referred to as "exemplary embodiments") will be described below with reference to the drawings, the invention is not limited to the following exemplary embodiments.

In order to facilitate understanding of the following description, in the drawings, the front/rear direction is indicated as an X-axis direction, the left/right direction is indicated as a Y-axis direction and the up/down direction is indicated as a Z-axis direction, and directions or sides designated by the arrows X, −X, Y, −Y, Z and −Z are indicated as the front direction, the rear direction, the right direction, the left direction, the upper direction and the lower direction, or the front side, the rear side, the right side, the left side, the upper side and the lower side respectively.

In the drawings, each arrow with "•" written in "o" means an arrow directed from the back side of the sheet to the front side thereof and each arrow with "x" written in "o" means an arrow directed from the front side of the sheet to the back side thereof.

In the following description using the drawings, any other member than members required for description is omitted from the drawings suitably for the purpose of facilitating understanding.

First Exemplary Embodiment

FIG. 1 is an overall view for explaining an image forming apparatus according to a first exemplary embodiment of the invention.

In FIG. 1, a printer U as an example of an image forming apparatus according to the first exemplary embodiment has a printer body U1 as an example of an image forming apparatus body. A front cover U1*a* is supported in the front surface of the printer body U1. The front cover U1*a* is an example of an openable member, which can be opened and closed around the lower end of the front cover U1*a* in order to insert and receive sheets S as an example of media. A discharge tray TRh as an example of a discharge portion to which the sheets S having images recorded thereon are discharged is formed on the top of the printer U. Further, a rear cover U1*b* as an example of an openable member which can be opened to reveal the inside of the printer body U1 in order to remove a paper jam or check the inside is supported in the rear surface of the printer body U1 so as to be rotatable between a closing position shown by the solid line in FIG. 1 and an opening position shown by the broken line in FIG. 1.

The printer U according the first exemplary embodiment has a controller C as an example of a control portion, an image processing portion IPS, a laser drive circuit DL as an example of a latent image forming circuit, a power supply unit E, etc. The operations of the image processing portion IPS, the laser drive circuit DL and the power supply unit E are controlled by the controller C. The power supply unit E applies voltages to a charging roll CR as an example of a charger, a developing roll Ga as an example of a developing member, a transfer roll Tr as an example of a transfer member, etc., which will be described later.

The image processing portion IPS converts print information into image information for forming a latent image. The print information is inputted from a host computer or the like as an example of an external information transmitting apparatus. The image processing portion IPS outputs the image information to the laser drive circuit DL at a predetermined timing. The laser drive circuit DL is an example of an image writing circuit. The laser drive circuit DL outputs a driving signal to a latent image forming unit LH in accordance with the inputted image information. The latent image forming unit LH according to the first exemplary embodiment is composed of a so-called LED head, which is a unit of LEDs (Light Emitting Diodes) arranged linearly in the left/right direction at predetermined intervals. Each LED is an example of a latent image writing element.

A photoconductor PR as an example of an image retainer, which is driven to rotate, is supported in a rear portion of the printer U. A charging roll CR, a latent image forming unit LH, a developing unit G, a transfer roll Tr and a photoconductor cleaner CL are disposed around the photoconductor PR and along the rotating direction of the photoconductor PR. The photoconductor PR is an example of a rotary member. The transfer roll Tr is an example of a transfer member. The photoconductor cleaner CL is an example of a cleaner for the image retainer.

In FIG. 1, a charging roll cleaner CRc is disposed in opposition to and in contact with the charging roll CR. The charging roll cleaner CRc is an example of a charger cleaner for cleaning the surface of the charging roll CR.

In addition, the developing unit G has a developing vessel V which stores a developer internally. A developing roll Ga, a pair of circulating conveyance members Gb and Gc, a supply member Gd and a layer thickness limiting member Ge are disposed in the developing vessel V. The developing roll Ga is an example of a developer retainer, which is disposed in opposition to the photoconductor PR. The circulating conveyance members Gb and Gc circulate and convey the developer while agitating the developer. The supply member Gd conveys, to the developing roll Ga, the developer agitated by the circulating conveyance members. The layer thickness limiting member Ge limits the layer thickness of the developer on the surface of the developing roll Ga.

A developer supply port V1 as an example of a supply portion is formed in the front upper surface of the developing vessel V. A developer supply path V3 as an example of a developer conveyance path, which extends frontally, is connected to the developer supply port V1. A supply auger V4 as an example of a developer conveyance member is rotatably supported inside the developer supply path V3. A cartridge holder KH as an example of an attachment/detachment portion, to/from which a toner cartridge TC can be attached/detached, is connected to the front end of the developer supply path V3. Thus, a developer from the toner cartridge TC can flow into the developer supply path V3. Accordingly, when the supply auger V4 is driven, a developer is supplied from the toner cartridge TC to the developing unit G in accordance with consumption of a developer in the developing unit G.

The surface of the photoconductor PR which is rotating is charged by the charging roll CR in a charging area Q1. In a latent image forming position Q2, an electrostatic latent image is formed in the surface of the photoconductor PR by latent image forming light emitted from the latent image forming unit LH. The electrostatic latent image is developed into a toner image in a developing area Q3 by the developing roll Ga. The toner image is an example of a visible image. In a transfer area Q4 which is formed out of an area where the photoconductor PR as an example of a rotary member is opposed to the transfer roll Tr as an example of an opposed member, the toner image on the surface of the photoconductor PR is transferred to a sheet S as an example of a medium by the transfer roll Tr. The transfer roll Tr according to the first exemplary embodiment is made of an elastic material so that the transfer roll Tr can be elastically deformed by contact with the photoconductor PR.

Residual toner on the surface of the photoconductor PR is removed by a cleaning blade CB in a cleaning area Q5 which is an example of a cleaning area set on the downstream side of the transfer area Q4. The cleaning blade CB is an example of a cleaning member. The removed toner is recovered into the photoconductor cleaner CL.

A film seal FS is provided oppositely to the cleaning blade CB. The film seal FS is an example of a scatter prevention member. The film seal FS prevents the toner recovered in the photoconductor cleaner CL from spilling out therefrom.

In FIG. 1, a pickup roll Rp as an example of a medium taking-out member is disposed in a paper feed tray TR1 in a lower portion of the printer U. Recording sheets S taken out by the pickup roll Rp are separated one by one by each separation roll Rs as an example of a medium separation member. The separation roll Rs includes a retard roll and a feed roll. The recording sheet S is conveyed to the transfer area Q4 at a predetermined timing by registration rolls Rr disposed on the upstream side of the transfer area Q4 in the sheet conveyance direction. Each registration roll Rr is an example of a medium adjustment member.

A transfer voltage is applied to the transfer roll Tr from the power supply unit E whose operation is controlled by the controller C. The transfer roll Tr transfers the toner image on the photoconductor PR to the recording sheet S which is passing through the transfer area Q4.

The recording sheet S to which the toner image has been transferred in the transfer area Q4 is conveyed to a fixing unit F in the state where the toner image has not yet been fixed. The fixing unit F has a pair of fixing rolls Fh and Fp as examples of fixing members. A fixing area Q6 is formed out of a pressure contact area between the pair of fixing rolls Fh and Fp. The toner image on the recording sheet S conveyed to the fixing unit F is fixed by the pair of fixing rolls Fh and Fp in the fixing area Q6. The recording sheet S where the fixed toner image has been formed is guided by sheet guides SG1 and SG2 and discharged to the discharge tray TRh on the top of the printer body U1 through discharge rolls R1. The sheet guides SG1 and SG2 are examples of medium guide members. Each discharge roll R1 is an example of a medium discharge member.

(Description of Rear Cover)

Figure 2:
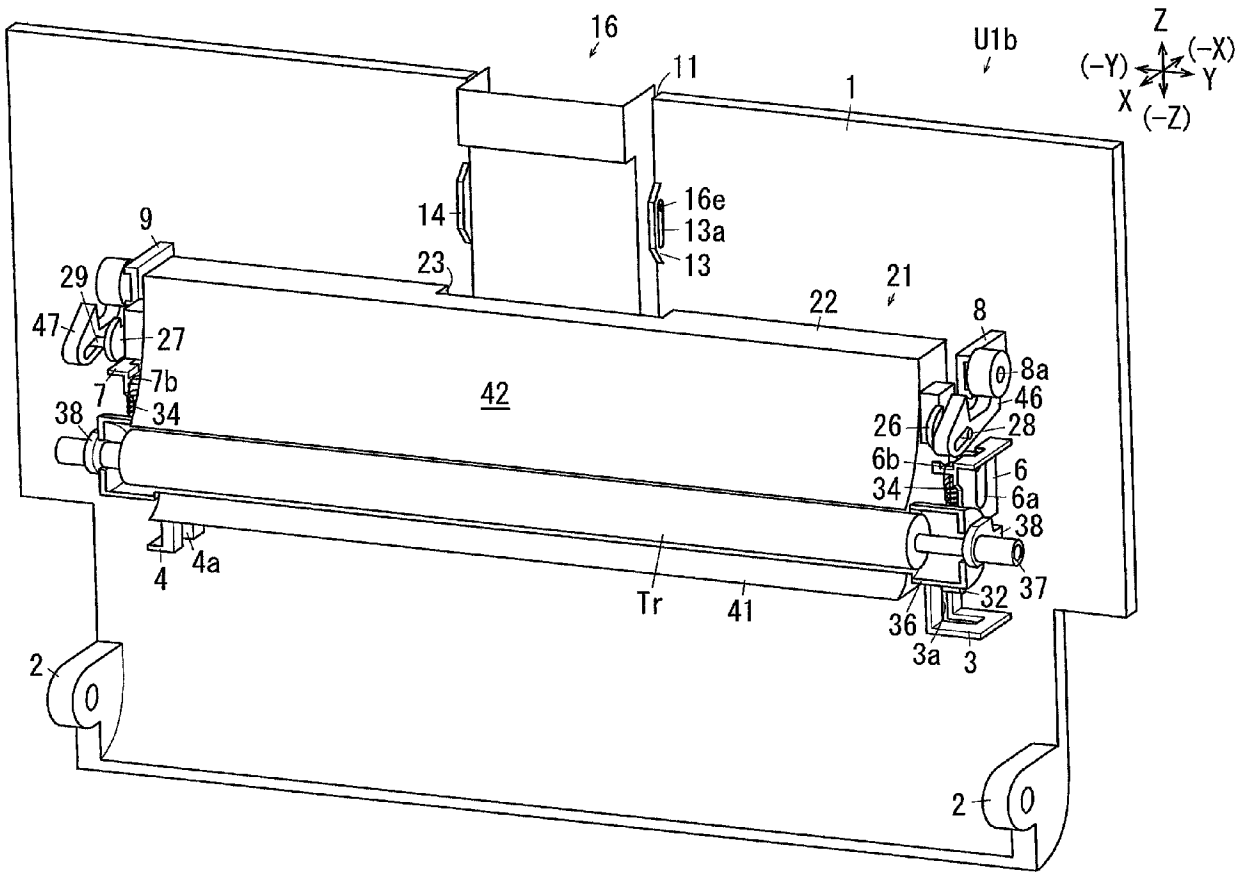
FIG. 2 is a perspective view of a rear cover as an example of an openable member according to the first exemplary embodiment.

FIG. 2 is a perspective view of a rear cover as an example of an openable member according to the first exemplary embodiment.

Figure 3:
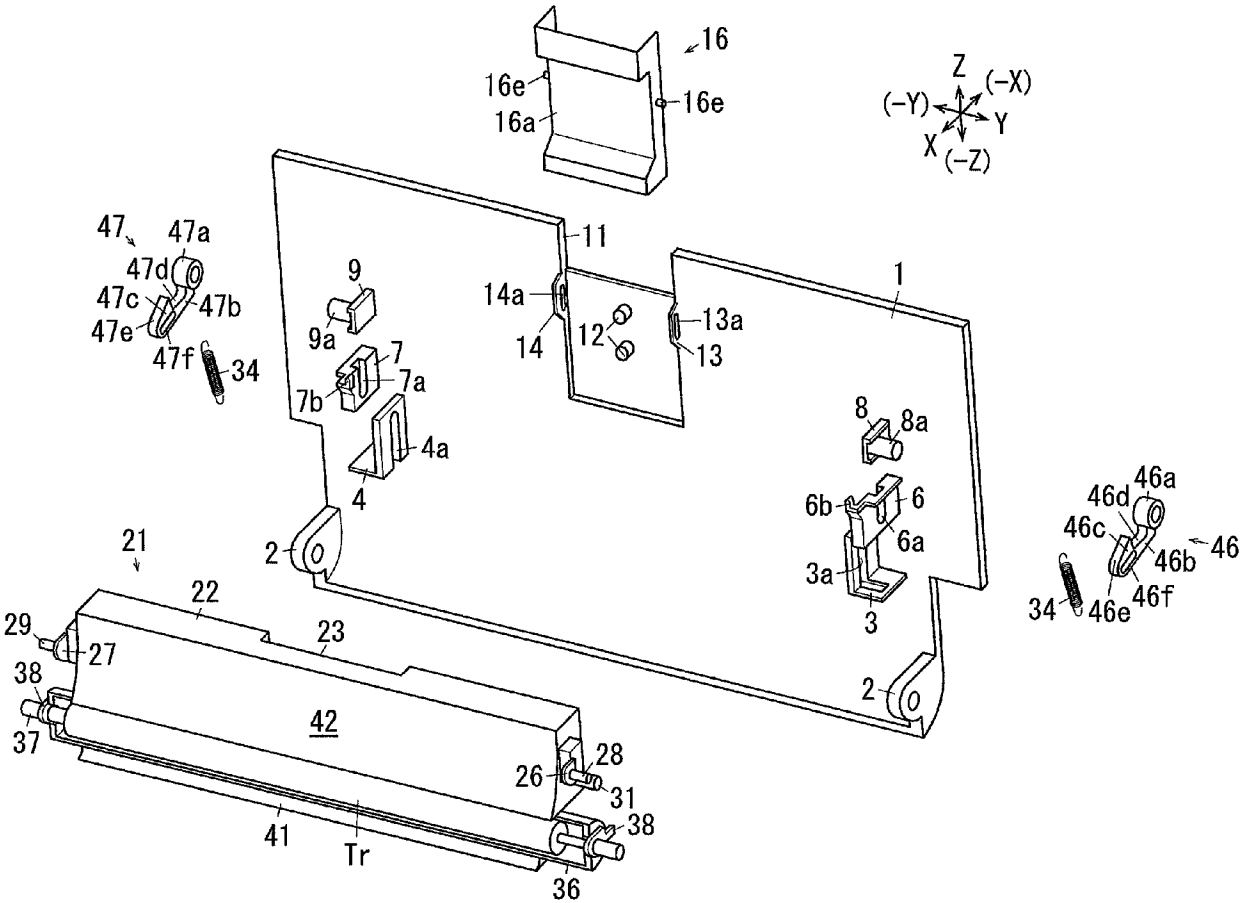
FIG. 3 is an exploded view for explaining the rear cover in FIG. 2.

FIG. 3 is an exploded view for explaining the rear cover in FIG. 2.

In FIGS. 2 and 3, the rear cover U1*b* according to the first exemplary embodiment has a rear cover body 1 as an example of a plate-like openable member body. A pair of left and right salient shaft portions 2 rotatably supported on the printer body U1 are formed in the lower end of the rear cover body 1.

Above the shaft portions 2, a pair of right and left lower holders 3 and 4 are formed into plates extending frontally. Each lower holder 3, 4 is an example of a lower holding portion. A lower guide groove 3*a*, 4*a* as an example of a lower guide portion, which extends in the up/down direction, is formed in each lower holder 3, 4. The lower guide groove 3*a*, 4*a* according to the first exemplary embodiment is formed into an inverted U-shape so that the lower guide groove 3*a*, 4*a* can prevent a transfer slider 21 from being detached upward. That is, the lower guide groove 3*a*, 4*a* also has a function as a stopper.

Above the lower holders 3 and 4 and outside the lower holders 3 and 4 in the left/right direction, a pair of right and left upper holders 6 and 7 are formed into plates extending frontally. Each upper holder 6, 7 is an example of an upper holding portion. An upper guide groove 6*a*, 7*a* as an example of an upper guide portion, which extends in the up/down direction, is formed in each upper holder 6, 7. The upper guide groove 6*a*, 7*a* according to the first exemplary embodiment is formed into a U-shape directed reversely to the lower guide groove 3*a*, 4*a*. Thus, the upper guide groove 6*a*, 7*a* can prevent the transfer slider 21 from being detached downward. In addition, a spring hook portion 6*b*, 7*b* as an example of an urging support portion is formed in the front end upper portion of the upper holder 6, 7.

Above the upper holders 6 and 7, a pair of right and left lock claw holders 8 and 9 are formed to protrude frontally. Each lock claw holder 8, 9 is an example of a fixed holding portion. In each lock claw holder 8, 9, a protruding claw bearing 8*a*, 9*a* as an example of a claw receiving portion is formed to protrude outward in the left/right direction.

In FIG. 3, at the upper end of the laterally central portion of the rear cover body 1, an operating opening 11 is formed into a downward concave shape. A pair of upper and lower handle guides 12 are formed under the operating opening 11. Each handle guide 12 is an example of an operation guide portion. On the opposite sides of the handle guides 12 in the left/right direction, handle holding ribs 13 and 14 are formed to protrude frontally. Each handle holding rib 13, 14 is an example of an operation holding portion. In each handle holding rib 13, 14, a handle lateral guide 13*a*, 14*a* as an example of an operation guide portion is formed into a long hole extending in the up/down direction.

Figure 4:
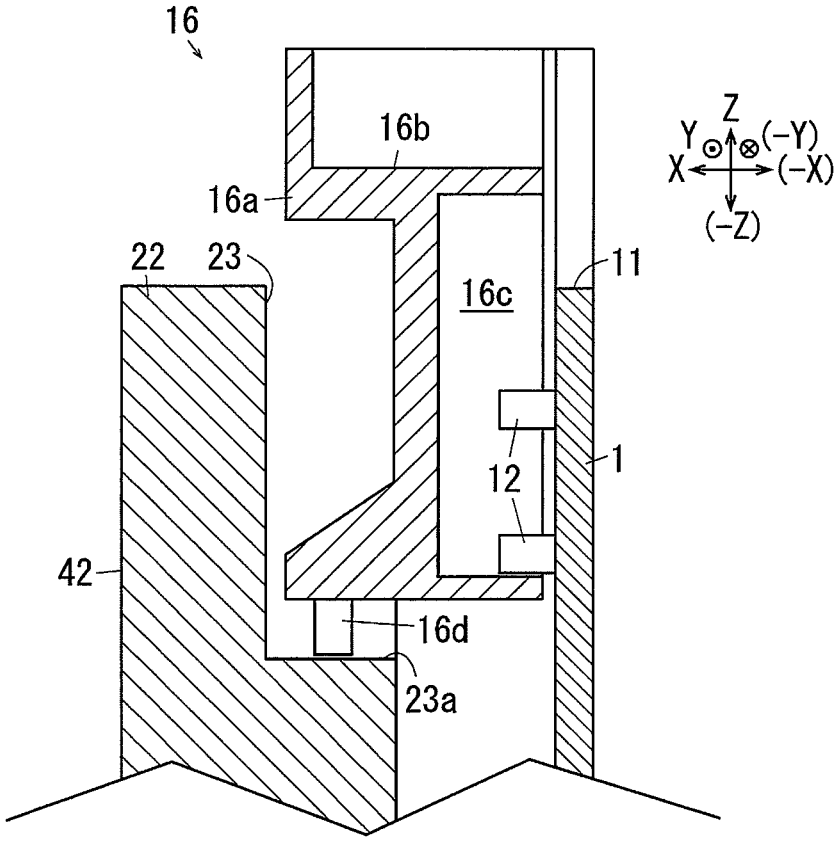
FIG. 4 is a main portion view for explaining a contact portion between an operating portion and a slider.

FIG. 4 is a main portion view for explaining a contact portion between an operating portion and a slider.

In FIGS. 3 and 4, a handle 16 as an example of the operating portion is disposed in front of the handle guides 12 and between the handle holding ribs 13 and 14. The handle 16 has a handle body 16*a* extending in the up/down direction.

In FIG. 4, at an upper end of the handle body 16*a*, an operating recess portion 16*b* is formed and disposed correspondingly to the operating opening 11 so that an operator can push the operating recess portion 16*b* with a finger of the operator.

Under the operating recess portion 16*b*, a guide recess portion 16*c* as an example of a guided portion is formed so that the handle guides 12 can be fitted to the guide recess portion 16*c* and guided in the up/down direction thereby.

In FIGS. 3 and 4, a sliding interlocking protrusion 16*d* as an example of an interlocking portion is formed to protrude downward on the lower surface of the handle body 16*a*.

In FIGS. 2 and 3, on the opposite, right and left ends of the handle body 16*a*, guide protrusions 16*e* as examples of guided portions are formed correspondingly to the handle lateral guides 13*a* and 14*a* to protrude outward in the left/right direction. The guide protrusions 16*e* fitted into the handle lateral guides 13*a* and 14*a* are guided in the up/down direction as they are.

In FIGS. 2 to 4, a transfer slider 21 as an example of a movable body is disposed under the handle 16. The transfer slider 21 includes a transfer slider body 22 extending in the left/right direction. In FIG. 4, a recess portion 23 corresponding to the handle 16 is formed in a rear surface of an upper end portion of the transfer slider body 22. The recess portion 23 is designed so that the sliding interlocking protrusion 16*d* of the handle 16 can come in contact with a lower surface 23*a* of the recess portion 23.

Figure 5:
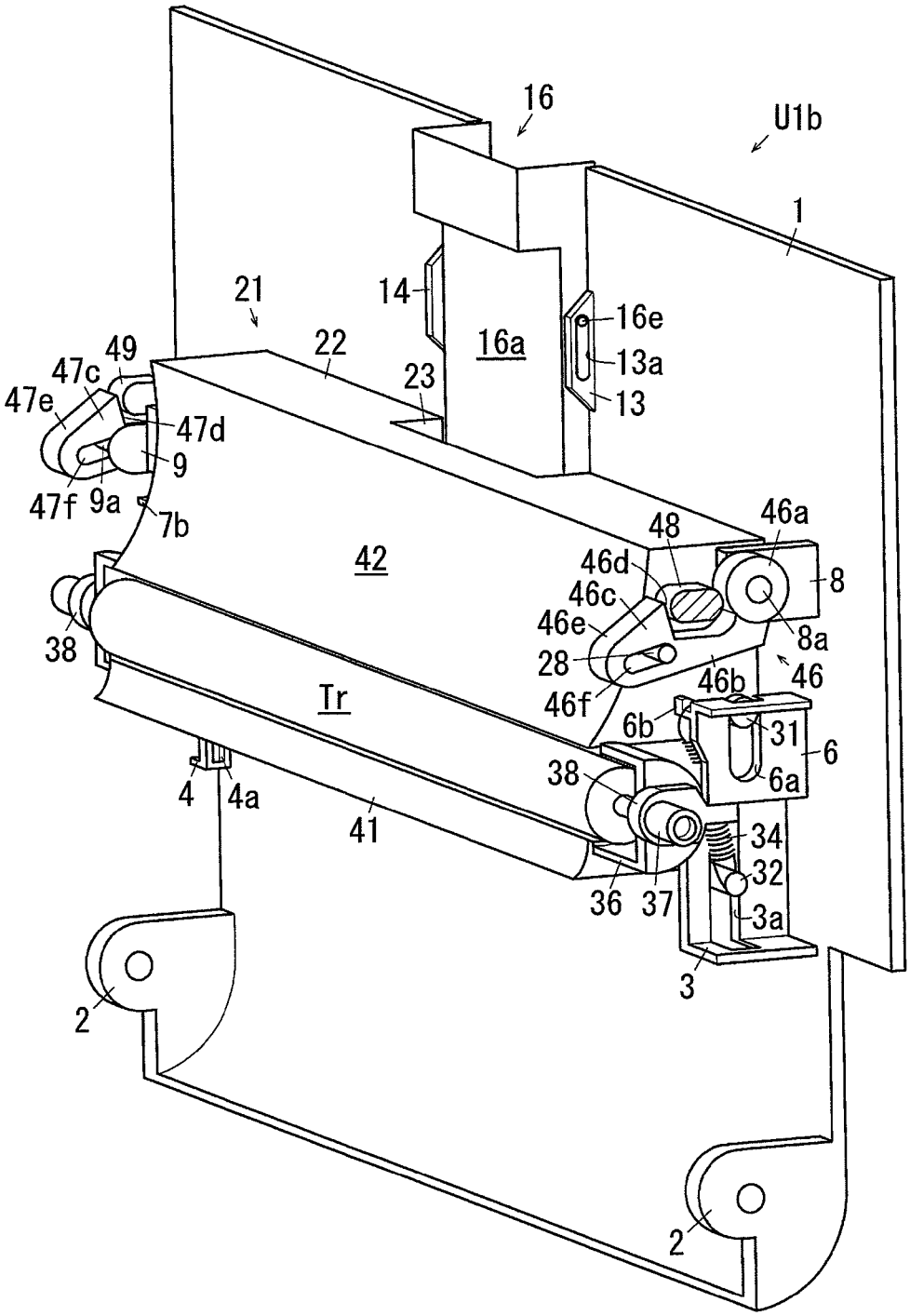
FIG. 5 is a perspective view for explaining the rear cover in the state where a transfer roll has been positioned.

FIG. 5 is a perspective view for explaining the rear cover in the state where a transfer roll has been positioned.

Figure 6:
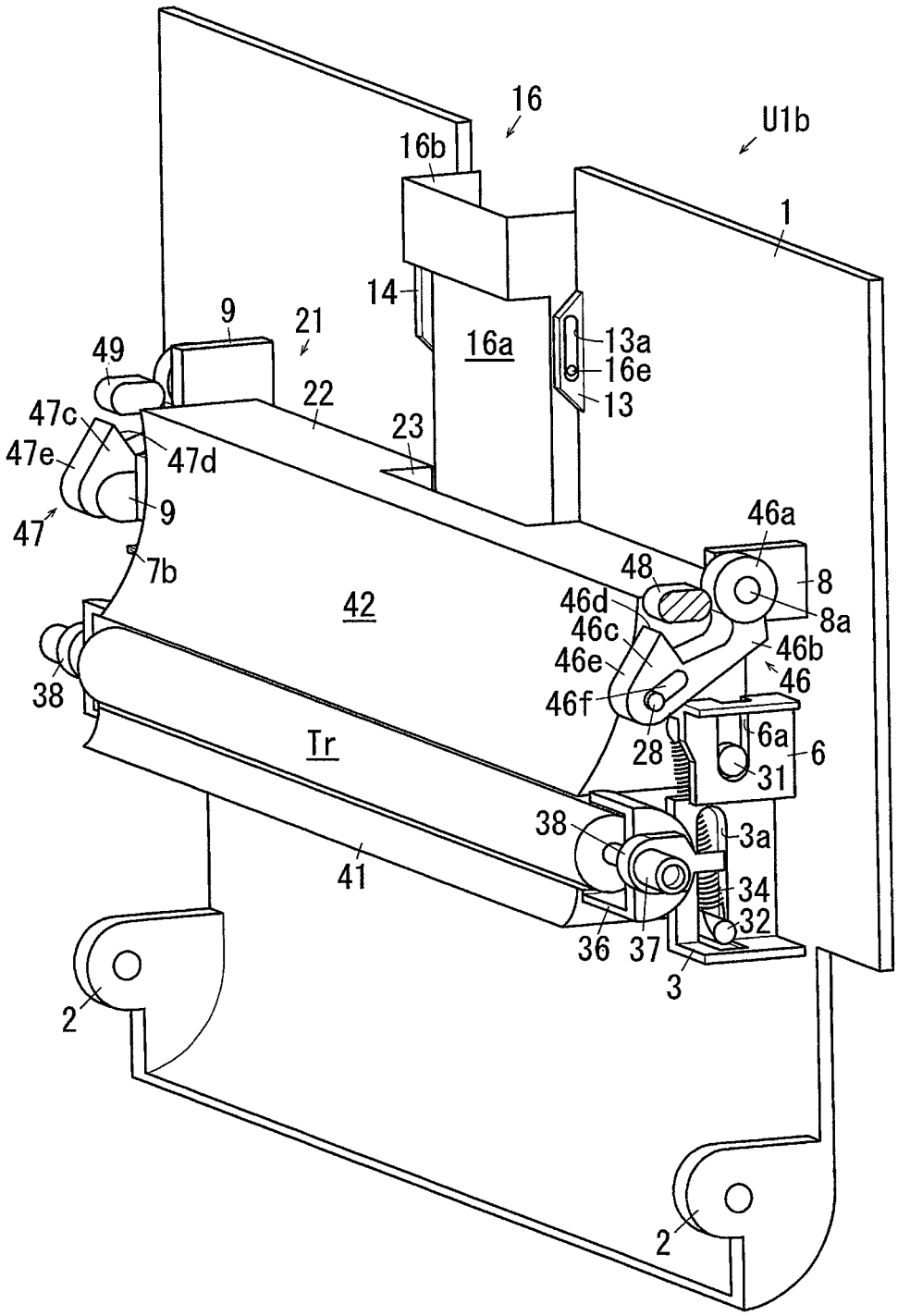
FIG. 6 is a perspective view for explaining the rear cover in the state where the transfer roll has been released from positioning.

FIG. 6 is a perspective view for explaining the rear cover in the state where the transfer roll has been released from positioning.

Figure 7:
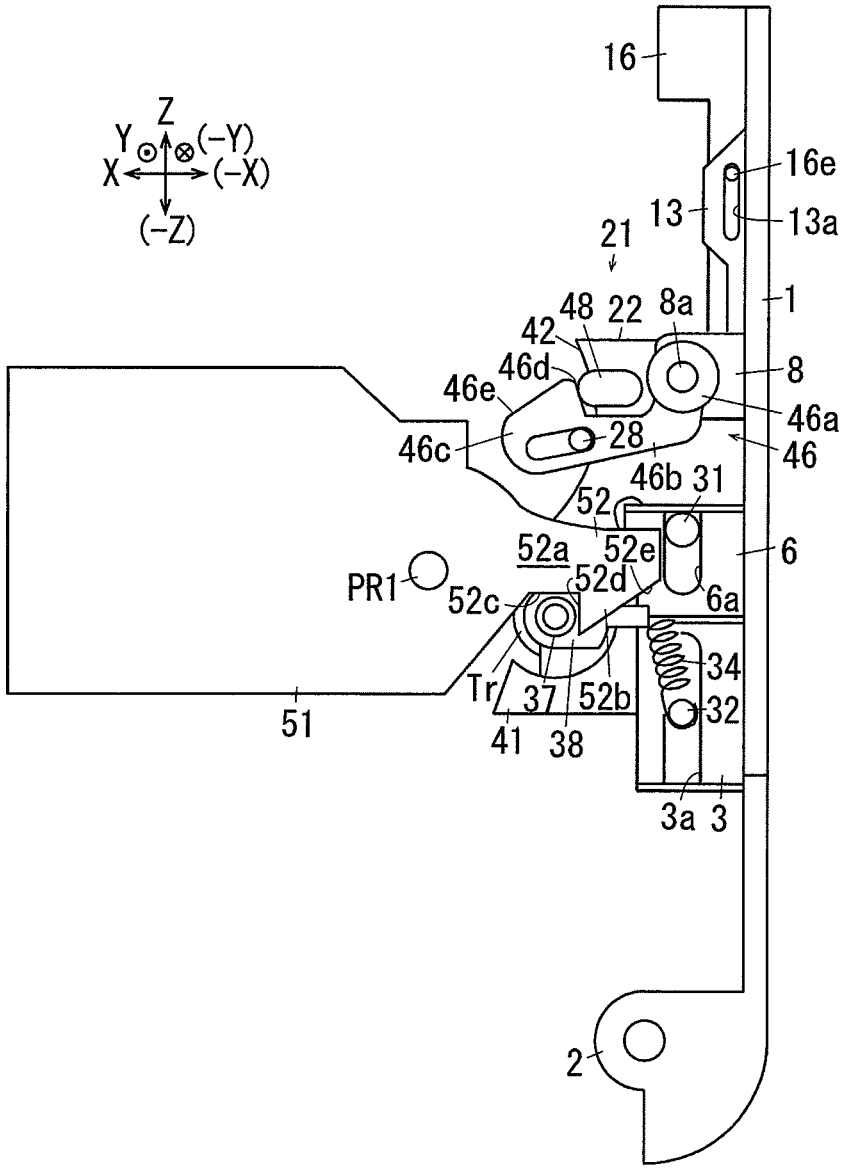
FIG. 7 is a main portion explanatory view in which the positioned transfer roll is viewed sideways.

FIG. 7 is a main portion explanatory view in which the positioned transfer roll is viewed sideways.

Figure 8:
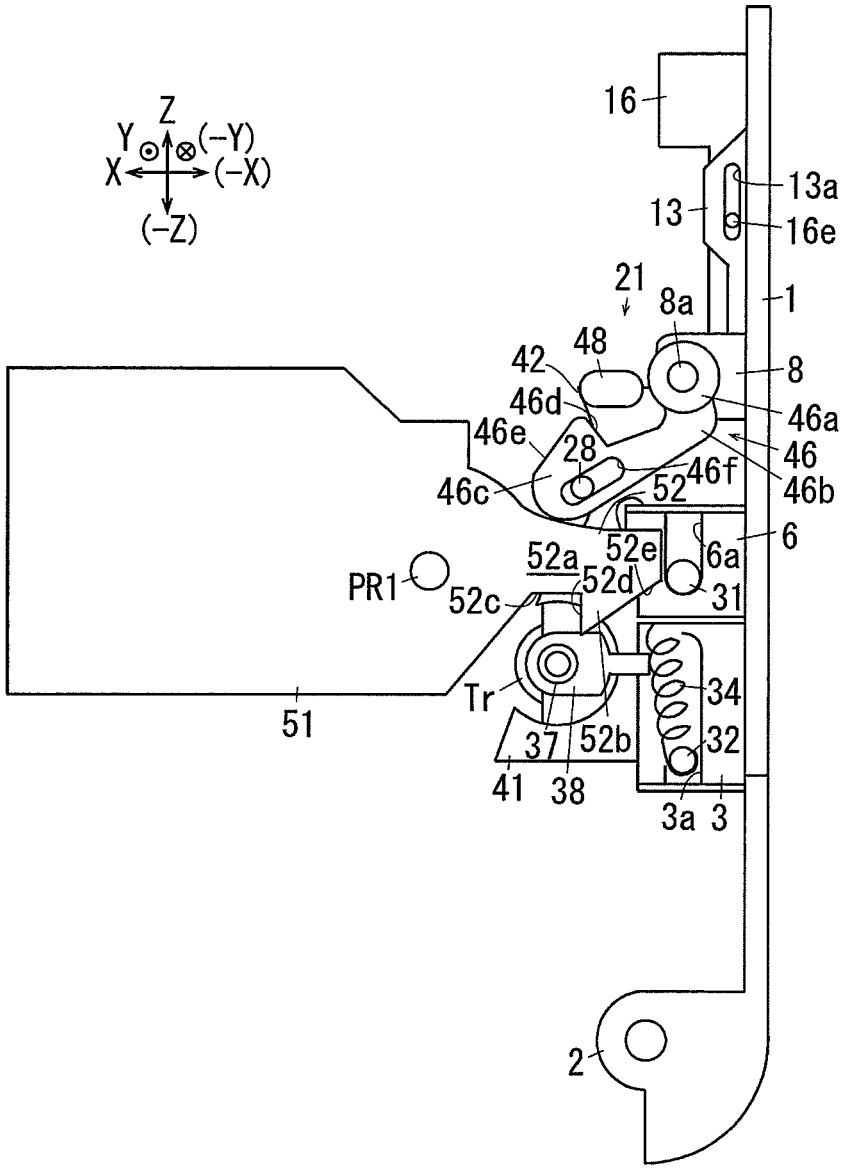
FIG. 8 is a main portion explanatory view in which the transfer rolled released from positioning is viewed sideways.

FIG. 8 is a main portion explanatory view in which the transfer rolled released from positioning is viewed sideways.

In FIGS. 2, 3 and 5-8, a pair of right and left plate-like interlocking holding flanges 26 and 27 extending frontally are formed on opposite (right and left) side surfaces of the transfer slider body 22. Each interlocking holding flange 26, 27 is an example of an interlocking holding portion. In the interlocking holding flanges 26 and 27, lock interlocking protrusions 28 and 29 extending outward in the left/right direction are formed respectively. Each lock interlocking protrusion 28, 29 is an example of an interlocking member.

In FIGS. 3 and 5-8, under the lock interlocking protrusions 28 and 29 and at the oblique rear of the lock interlocking protrusions 28 and 29, upper guide protrusions 31 are formed correspondingly to the upper guide grooves 6*a* and 7*a* to protrude outward in the left/right direction. Each upper guide protrusion 31 is an example of a guided portion. In the drawings, the left upper guide protrusion 31 is not shown, but only the right upper guide protrusion 31 is shown. The left upper guide protrusion is arranged in the same manner as the right upper guide protrusion, except they are symmetrical. Thus, detailed description of the left upper guide protrusion will be omitted. In the following description, in the same manner, right members will be explained, but illustration and detailed description of left members will be omitted appropriately.

Each upper guide protrusion 31 according to the first exemplary embodiment is formed into a column with an outer diameter corresponding to and substantially equal to the width of the upper guide groove 6*a*, 7*a*. The upper guide protrusion 31 fitted to the upper guide groove 6*a*, 7*a* without much looseness is supported movably in the up/down direction.

In FIGS. 5 to 8, under the upper guide protrusions 31, lower guide protrusions 32 are formed correspondingly to the lower guide grooves 3*a* and 4*a* to protrude outward in the left/right direction. Each lower guide protrusion 32 is an example of a guided portion. Each lower guide protrusion 32 according to the first exemplary embodiment is formed into a column with an outer diameter smaller than the width of the lower guide groove 3*a*, 4*a* so as to secure looseness and form so-called allowance. Thus, the lower guide protrusion 32 fitted to the lower guide groove 3*a*, 4*a* with allowance is supported movably in the up/down direction.

In addition, in the laterally outer end portions of the lower guide protrusions 32, spring hook portions are formed correspondingly to the spring hook portions 6*b* and 7*b*. Each spring hook portion is an example of an urging support portion.

A pair of right and left coil springs 34 are mounted between the spring hook portions 6*b* and 7*b* of the upper holders 6 and 7 and the spring hook portions 32*a* of the lower guide protrusions 32 respectively. Each coil spring 34 is an example of an urging member. Each coil spring 34 according to the first exemplary embodiment applies a force to the lower guide protrusion 32 to pull the lower guide protrusion 32 toward the spring hook portion 6*b*, 7*b*, that is, obliquely frontally and upward. Thus, the lower guide protrusion 32 with looseness between the lower guide protrusion 32 and the lower guide groove 3*a*, 4*a* is retained to be pressed onto the front surface of the lower guide groove 3*a*, 4*a*.

As a result, the guide protrusions 31 and 32 are guided by the guide grooves 3*a*, 4*a*, 6*a* and 7*a* respectively so that the transfer slider 21 according to the first exemplary embodiment can be supported on the rear cover U1*b* movably in the up/down direction.

A semi-cylindrical transfer holder 36 extending in the left/right direction is supported as an example of a transfer holding portion on a lower portion of the transfer slider body 22. The transfer roll Tr is received in the transfer holder 36. A rotary shaft 37 of the transfer roll Tr is rotatably supported on the transfer holder 36 with its opposite end portions supported on bearing members 38. According to the first exemplary embodiment, the rotary shaft 37 of the transfer roll Tr is supported with its outer ends protruding outside the bearing members 38 in the left/right direction respectively. Each outer end of the rotary shaft 37 serves as an example of a positioned portion.

In a front surface of the transfer slider body 22, a pretransfer guide 41 as an example of a medium guide member is formed under the transfer holder 36 so as to guide the sheet S to the transfer area Q4, while a post-transfer guide 42 as an example of a medium guide member is formed above the transfer holder 36. By the post-transfer guide 42, the sheet S having passed through the transfer area Q4 is guided to the fixing unit F.

In FIGS. 2, 3 and 5-8, a pair of right and left lock members 46 and 47 are supported on the lock claw holders 8 and 9 respectively. Each lock member 46, 47 is an example of a fixed portion. Each lock member 46, 47 has a rotation center portion 46*a*, 47*a* fitted to the claw bearing 8*a*, 9*a* and rotatably supported thereon. An arm portion 46*b*, 47*b* extending frontally is formed integrally with the rotation center portion 46*a*, 47*a*. A claw portion 46*c*, 47*c* swelling upward is formed integrally with a front end of the arm portion 46*b*, 47*b*. A fixed face 46*d*, 47*d* is formed in a rear surface of the claw portion 46*c*, 47*c*, while an insertion guide face 46*e*, 47*e* inclined downward toward the front is formed in an upper surface of the claw portion 46*c*, 47*c*.

In the front end portion of each arm portion 46*b*, 47*b*, an interlocking long hole 46*f*, 47*f* extending in the front/back direction is formed correspondingly to the lock interlocking protrusion 28, 29. The interlocking long hole 46*f*, 47*f* is an example of an interlocked portion. The lock interlocking protrusion 28, 29 is fitted into the interlocking long hole 46*f*, 47*f*. The lock member 46, 47 interlocks with the vertical movement of the transfer slider 21 and is supported rotatably around the rotation center portion 46*a*, 47*a*.

In FIGS. 5 to 8, in the printer body U1, a pair of right and left lock protrusions 48 and 49 are disposed in positions corresponding to the lock members 46 and 47 and fixedly supported on a not-shown frame. Each lock protrusion 48, 49 is an example of an opening/closing fixing portion. Thus, each lock member 46, 47 can rotate around the rotation center portion 46*a*, 47*a* to touch and leave the lock protrusion 48, 49. When the lock member 46, 47 touches the lock protrusion 48, 49, the claw portion 46*d*, 47*d* is hooked to retain or lock the rear cover U1*b* in the state where the rear cover U1*b* closes the rear surface of the printer body U1.

In FIGS. 7 and 8, in the printer body U1, a process frame 51 is supported as an example of a frame for supporting the photoconductor PR, the charging roll CR, the photoconductor cleaner CL, etc. A transfer positioning portion 52 as an example of a positioning portion, which extends behind a rotation shaft PR1 of the photoconductor PR, is formed integrally with the process frame 51. The transfer positioning portion 52 has an upper positioning portion 52*a* as an example of a first positioning portion, which extends above and behind the rotation shaft 37 of the transfer roll Tr. A rear positioning portion 52*b* as an example of a second positioning portion, which extends downward like a claw, is formed integrally with a rear end of the upper positioning portion 52*a*.

In a lower surface of the upper positioning portion 52*a*, an upper positioning face 52*c* is formed as an example of a moving-direction positioning portion. The upper positioning face 52*c* comes in contact with an upper outer circumferential surface of the rotation shaft 37 of the transfer roll Tr so as to position the transfer roll Tr in the up/down direction, that is, in the moving direction of the transfer slider 21. In addition, a rear positioning face 52*d* as an example of an opposite-direction positioning portion is formed in the left surface of the rear positioning portion 52*b*. The rear positioning face 52*d* comes in contact with a rear outer circumferential surface of the rotation shaft 37 of the transfer roll Tr so as to position the transfer roll Tr in the left/right direction, that is, on the opposite side to the photoconductor PR in the opposite direction in which the transfer roll Tr and the photoconductor PR are opposed to each other.

A transfer guide face 52*e* as an example of an insertion guide portion is formed in a rear lower surface of the rear positioning portion 52*b*. The transfer guide face 52*e* is inclined upward toward the rear.

Operation of the First Exemplary Embodiment

In the printer U configured thus according to the first exemplary embodiment, assume that the operator opens the rear cover U1*b*, for example, in order to remove the sheet S jammed in a sheet conveyance path SH. When the operating recess portion 16*b* is pushed down with a finger having passed through the operating opening 11 in such a case, the handle 16 is guided by the guides 12, 13*a* and 14*a* to move down. Thus, the handle 16 moves from the contactable position shown in FIGS. 5 and 7 to the releasable position shown in FIGS. 6 and 8.

As the handle 16 moves down, the transfer slider 21 is pressed onto the sliding interlocking protrusion 16*d* of the handle 16. As a result, the guide protrusions 31 and 32 of the transfer slider 21 are guided by the guide grooves 6*a*, 7*a* and 3*a*, 4*a* so as to move down against the elastic force of the coil springs 34. Thus, the transfer slider 21 is moved from the positioning position shown in FIGS. 5 and 7 to the leaving position shown in FIGS. 6 and 8. With this movement, the transfer roll Tr supported on the transfer slider 21 also moves down integrally to release the rotation shaft 37 of the transfer roll Tr from contact with the transfer positioning portion 52 as shown in FIGS. 6 and 8.

As the transfer slider 21 moves down, the lock interlocking protrusions 28 and 29 of the transfer slider 21 move down to rotate the lock members 46 and 47 downward through the interlocking long holes 46*f* and 47*f* into which the lock interlocking protrusions 28 and 29 are fitted respectively. Accordingly, the lock members 46 and 47 move from the opening/closing fixing positions where the lock members 46 and 47 have been hooked on the lock protrusions 48 and 49 as shown in FIGS. 5 and 7 to the fixing releasing positions where the lock members 46 and 47 have left the lock protrusions 48 and 49 as shown in FIGS. 6 and 8. According to the first exemplary embodiment, in this manner, the lock members 46 and 47 move interlocking with the operation of the handle 16 through the intermediary of the transfer slider 21.

Released from locking with the lock members 46 and 47, the rear cover U1*b* is made openable and closable. Thus, the rear cover U1*b* can move from the closing position shown by the solid line in FIG. 1 toward the opening position shown by the broken line in FIG. 1. When the rear cover U1*b* moves to the opening position, the inside of the printer body U1 is revealed so that the sheet S jammed in the sheet conveyance path SH can be removed, or worn parts can be replaced, cleaned or checked.

When the operator makes his/her finger leave the handle 16 after the handle 16 moves to the releasable position, the elastic restoring force of the coil springs 34 acts on the transfer slider 21 to return the transfer slider 21 from the leaving position to the positioning position. As a result, the sliding interlocking protrusion 16*d* is pushed by the transfer slider 21. Thus, the handle 16 also returns from the releasable position to the contactable position, and the lock members 46 and 47 also return from the fixing releasing position to the opening/closing fixing position.

That is, in the rear cover U1*b* according to the first exemplary embodiment, when the rear cover U1*b* moves toward the opening position, the transfer roll Tr once moves down in a moving direction crossing the opening/closing direction of the rear cover U1*b* and then returns upward.

Assume that the rear cover U1*b* having moved to the opening position is returned to the closing position. In this case, when the rear cover U1*b* is returned to the closing position by the operator who is pushing down the handle 16, the state shown in FIGS. 6 and 8 is established. When the operator makes his/her finger leave the handle 16, the state shown in FIGS. 5 and 7 is resumed. At that time, the rotation shaft 37 of the transfer roll Tr is positioned by the transfer positioning portion 52. According to the first exemplary embodiment, the transfer positioning portion 52 is fixed to the printer body U1. This configuration is higher in accuracy of position than the configuration where a rotating positioning member is provided. Thus, the photoconductor PR and the transfer roll Tr are positioned so accurately that failure in transfer or deterioration in image quality can be reduced.

In addition, according to the first exemplary embodiment, the transfer positioning portion 52 is supported integrally with the process frame 51 which retains the photoconductor PR. In comparison with the case where the transfer positioning portion 52 is formed separately from the process frame 51, an accumulated error of parts etc. is reduced and the accuracy of position between the photoconductor PR and the transfer roll Tr supported on the rear cover U1*b* to be opened and closed can be improved.

Further, according to the first exemplary embodiment, the rotation shaft 37 of the transfer roll Tr is positioned by contact with the upper positioning face 52*c* and the rear positioning face 52*d*. Thus, the rotation shaft 37 is positioned from the two directions. Therefore, the accuracy of position can be improved, in comparison with the case where the rotation shaft 37 is positioned from only one direction. Particularly on the opposite side of the transfer roll Tr to the photoconductor PR, that is, on the rear side of the transfer roll Tr which is elastically deformed to leave the photoconductor PR by its elastic restoring force, the transfer roll Tr is positioned by the rear positioning face 52*d*. Thus, the transfer roll Tr can be positioned more accurately, in comparison with the case where the transfer roll Tr is not positioned by the rear positioning face 52*d*.

In addition, according to the first exemplary embodiment, allowance is provided between each lower guide groove 3*a*, 4*a* and each lower guide protrusion 32. Even if the transfer slider 21 is caught when the transfer slider 21 moves up or down, the transfer slider 21 can move slightly or rotate around the upper guide protrusion 31 side. Thus, operation can be performed stably and easily to suspend the transfer roll Tr on the transfer positioning portion 52 easily, in comparison with the case where no allowance is provided between each lower guide groove 3*a*, 4*a* and each lower guide protrusion 32.

The lower guide protrusions 32 are pulled obliquely upward by the coil springs 34. When the rear cover U1*b* has moved to the closing position, looseness can be suppressed to retain the rear cover U1*b* in a stable position. At that time, due to the elastic force of the coil springs 34, a component of the force to rotate the transfer slider 21 around the upper guide protrusions 31 acts on the transfer slider 21 so that a force can be applied to press the transfer roll Tr onto the photoconductor PR. Thus, the photoconductor PR and the transfer roll Tr can be brought into contact with each other surely, and the accuracy of position can be improved.

In addition, according to the first exemplary embodiment, there is not provided urging members such as springs or the like for pressing the transfer roll Tr onto the photoconductor PR. When the transfer roll Tr is pressed onto the photoconductor PR in the background-art configuration where spring bearings are disposed on the rear cover U1*b* side, the reaction force of springs act on the rear cover U1*b* in the state where the transfer roll Tr is in contact with the photoconductor PR. It is therefore necessary to enhance the rigidity of the rear cover U1*b* to make the cover high in cost and large in size. On the contrary, according to the first exemplary embodiment, there is not provided members with which the rear cover U1*b* may suffer a reaction force from the printer body U1 side in the state where the transfer roll Tr is in contact with the photoconductor PR, such as the springs for pressing the transfer roll Tr onto the photoconductor PR. In addition, the rotation shaft 37 of the transfer roll Tr which is pressed onto the photoconductor PR and elastically deformed to produce a reaction force is received by the transfer positioning portion 52 on the printer body U1 side. Thus, the reaction force is received not by the rear cover U1*b* but by the printer body U1 side. Accordingly, the force acting on the rear cover U1*b* in the closing position is reduced as compared with that in the background-art configuration. The rigidity of the rear cover U1*b* can be suppressed in comparison with that in the background-art configuration so that the rear cover U1*b* can be made small in size and low in cost.

When the rear cover U1*b* having moved to the opening position is returned to the closing position, the operator may return the rear cover U1*b* to the closing position with his/her finger apart from the handle 16. In this case, due to the elastic force of the coil springs 34, the transfer slider 21, the handle 16 and the lock members 46 and 47 are kept in the state shown in FIGS. 5 and 7, while the rear cover U1*b* rotates itself from the opening position toward the closing position. On this occasion, with the rotation of the rear cover U1*b*, the insertion guide faces 46*e* and 47*e* of the lock members 46 and 47 touches the lock protrusions 48 and 49. When the rear cover U1*b* is further pushed toward the closing position in the state where the insertion guide faces 46*e* and 47*e* is in contact with the lock protrusions 48 and 49, the lock members 46 and 47 once rotate toward the fixing releasing position. Then, when the insertion guide faces 46*e* and 47*e* pass through the lock protrusions 48 and 49, the lock members 46 and 47 return to the opening/closing fixing position due to the elastic force of the coil springs 34. Thus, the lock members 46 and 47 are brought into the state shown in FIGS. 5 and 7.

On this occasion, in the same manner, the rotation shaft 37 of the transfer roll Tr also touches the transfer guide face 52*e* of the transfer positioning portion 52. The transfer roll Tr is guided downward to once move the transfer slider 21 down toward the leaving position. After that, when the transfer roll Tr passes through the transfer guide face 52*e*, the transfer slider 21 returns to the positioning position due to the elastic force of the coil springs 34. Thus, the transfer slider 21 is brought into the state shown in FIGS. 5 and 7.

That is, according to the rear cover U1*b* in the first exemplary embodiment, also when the rear cover U1*b* moves toward the closing position, the transfer roll Tr once moves down in the moving direction crossing the opening/closing direction of the rear cover U1*b*, and then moves up back.

Second Exemplary Embodiment

Figure 9:
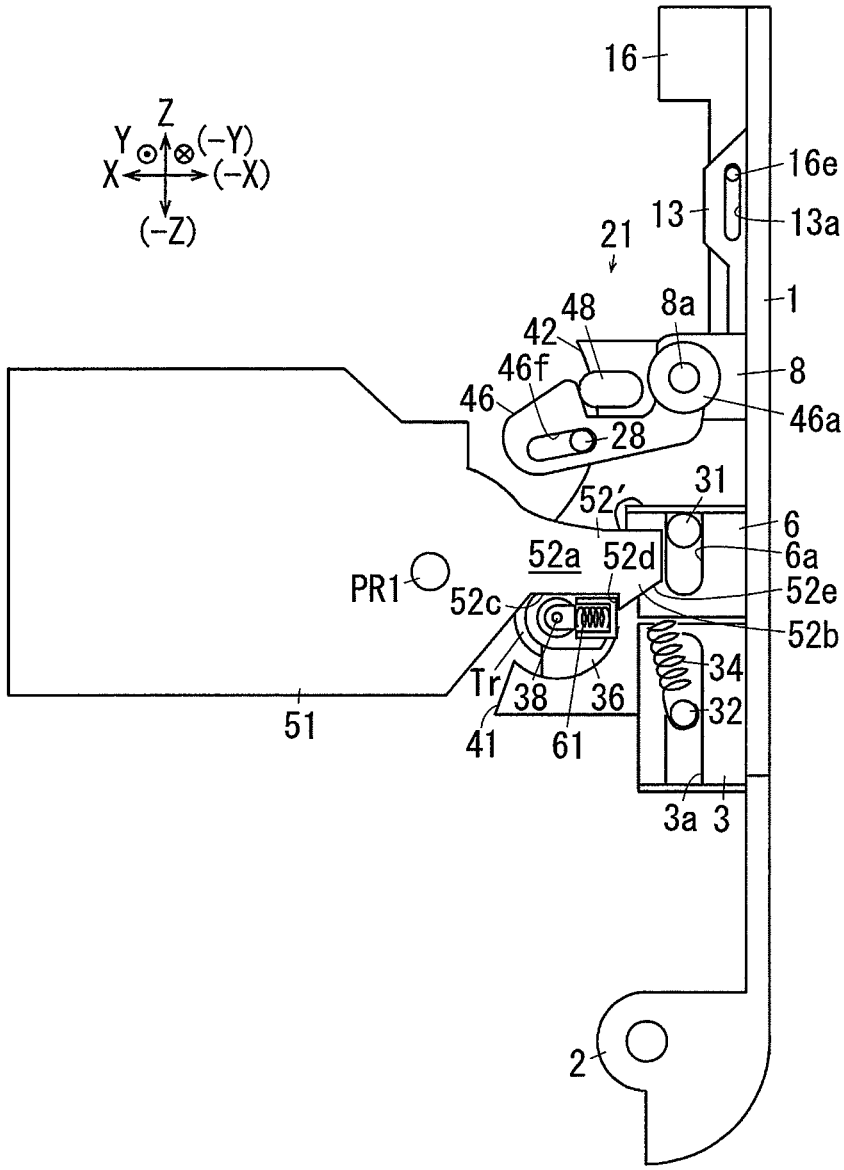
FIG. 9 is an explanatory view of an image forming apparatus according to a second exemplary embodiment, which view corresponds to FIG. 7 of the first exemplary embodiment.

FIG. 9 is an explanatory view of an image forming apparatus according to a second exemplary embodiment of the invention, which view corresponds to FIG. 7 of the first exemplary embodiment.

Next, the second exemplary embodiment will be described. In the description of the second exemplary embodiment, constituent elements corresponding to those of the first exemplary embodiment are referred to by the same numerals, and detailed description thereof will be omitted.

This exemplary embodiment is configured in the same manner as the first exemplary embodiment, except the following points.

In the first exemplary embodiment, the bearing member 38 is fixedly supported on the transfer holder 36. Instead, in FIG. 9, in the printer U according to the second exemplary embodiment, the bearing member 38 as an example of a transfer urging member is supported on the transfer holder 36 as an example of an urging support, movably in the left/right direction through the intermediary of a transfer pressure spring 61 which urges the transfer roll Tr toward the photoconductor PR. In addition, a transfer positioning portion 52' according to the second exemplary embodiment performs positioning not by contact with the rotation shaft 37 of the transfer roll Tr but by contract with the rear surface of the transfer holder 36 at the rear of the transfer pressure spring 61.

Operation of Second Exemplary Embodiment

In the printer U configured thus according to the second exemplary embodiment, the transfer positioning portion 52' performs positioning by contact with the position corresponding to the transfer pressure spring 61 in the state where the transfer slider 21 has moved to the positioning position shown in FIG. 9. Accordingly, even when the transfer pressure spring 61 applies a force to push the transfer holder 36 backward, the force does not act directly on the cover body 1 but is received by the transfer positioning portion 52' of the printer body U1. Thus, in the state where the transfer roll Tr is in contact with the photoconductor PR, it is not necessary to make the rigidity of the rear cover U1*b* higher than necessity, but the rear cover U1*b* can be made small in size and lower in cost.

The rear cover U1*b* according to the second exemplary embodiment operates in the same manner as the rear cover U1*b* according to the first exemplary embodiment, so that detailed description of the operation will be omitted.

Third Exemplary Embodiment

Figure 10:
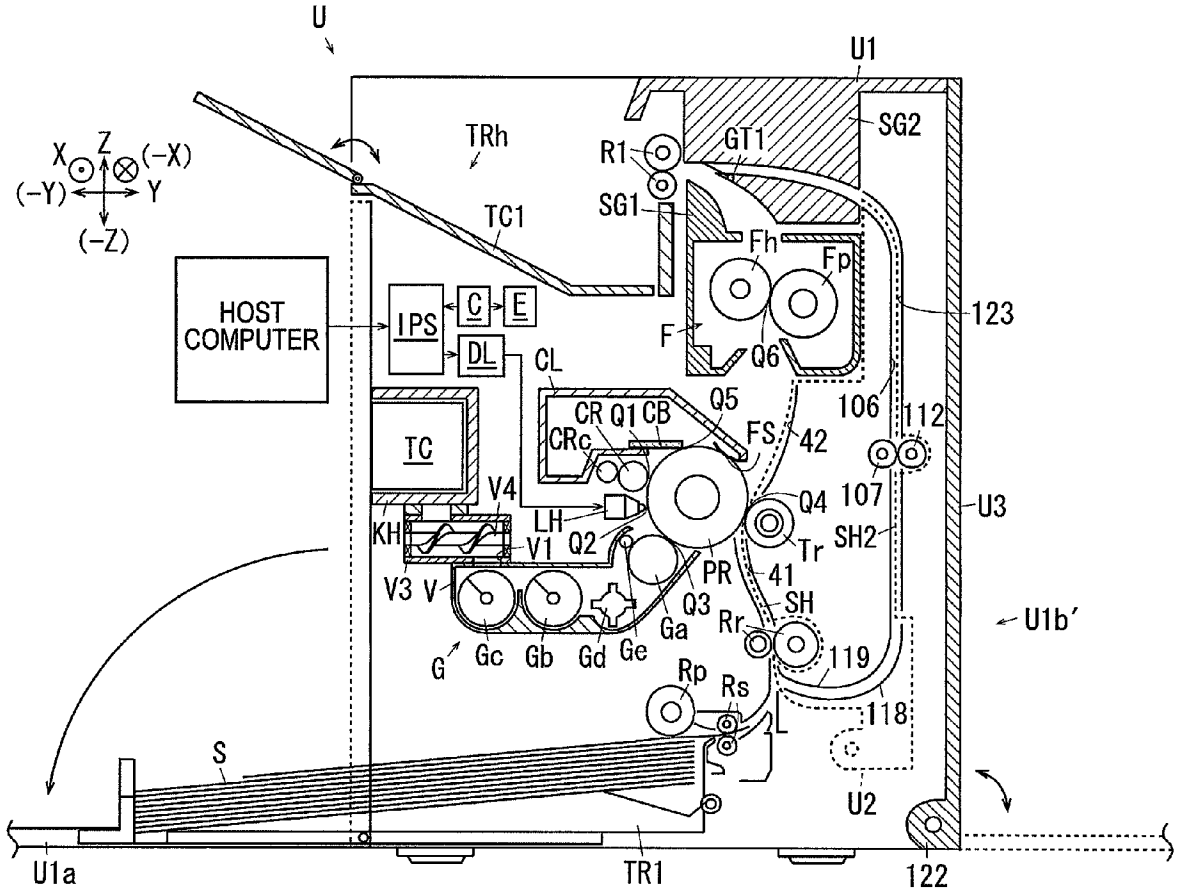
FIG. 10 is an explanatory view of an image forming apparatus according to a third exemplary embodiment, which view corresponds to FIG. 1 of the first exemplary embodiment.

FIG. 10 is an explanatory view of an image forming apparatus according to a third exemplary embodiment of the invention, which view corresponds to FIG. 1 of the first exemplary embodiment.

Next, the third exemplary embodiment will be described. In the description of the third exemplary embodiment, constituent elements corresponding to those of the first exemplary embodiment are referred to by the same numerals, and detailed description thereof will be omitted.

This exemplary embodiment is configured in the same manner as the first exemplary embodiment, except the following points.

In FIG. 10, in the printer U according to the third exemplary embodiment, an inversion path SH2 is provided to extend backward from the discharge rolls R1, extend downward behind the transfer roll Tr, and be connected to the registration rolls Rr. When double-sided printing is carried out, the discharge rolls R1 rotate reversely as soon as a conveyance-direction rear end of the sheet S on one side of which an image has been recorded reaches the discharge rolls R1. Thus, the sheet S is guided by a gate GT1 as an example of a switching member and conveyed to the inversion path SH2. The sheet S conveyed through the inversion path SH2 is conveyed to the registration rolls Rr. The sheet S which has been reversed is conveyed to the transfer area Q4, and an image is recorded on the second side of the sheet S.

Figure 11:
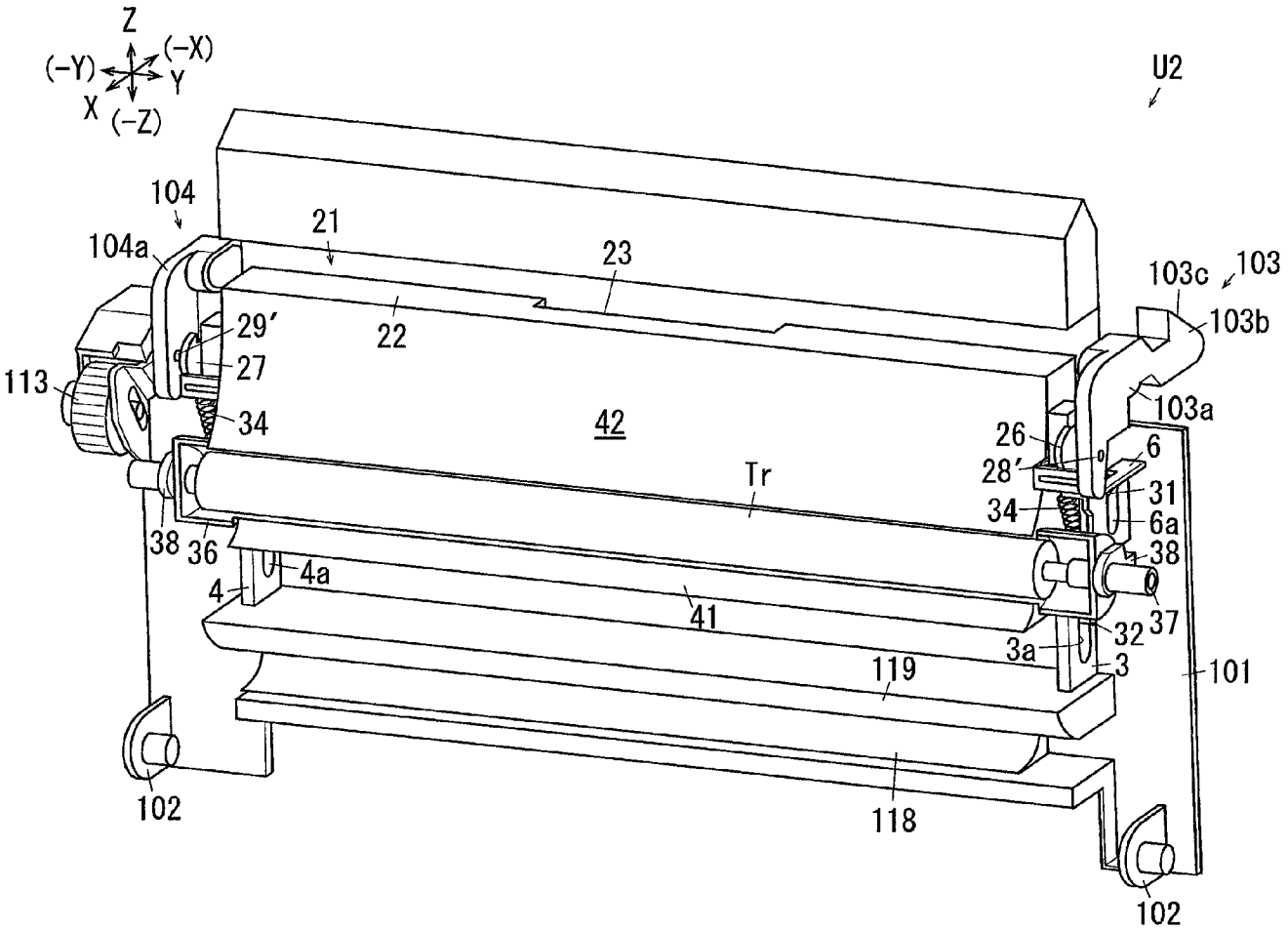
FIG. 11 is a perspective view of an inside cover of a rear cover according to the third exemplary embodiment, which view corresponds to FIG. 2 of the first exemplary embodiment.

FIG. 11 is a perspective view of an inside cover of a rear cover according to the third exemplary embodiment, which view corresponds to FIG. 2 of the first exemplary embodiment.

Figure 12:
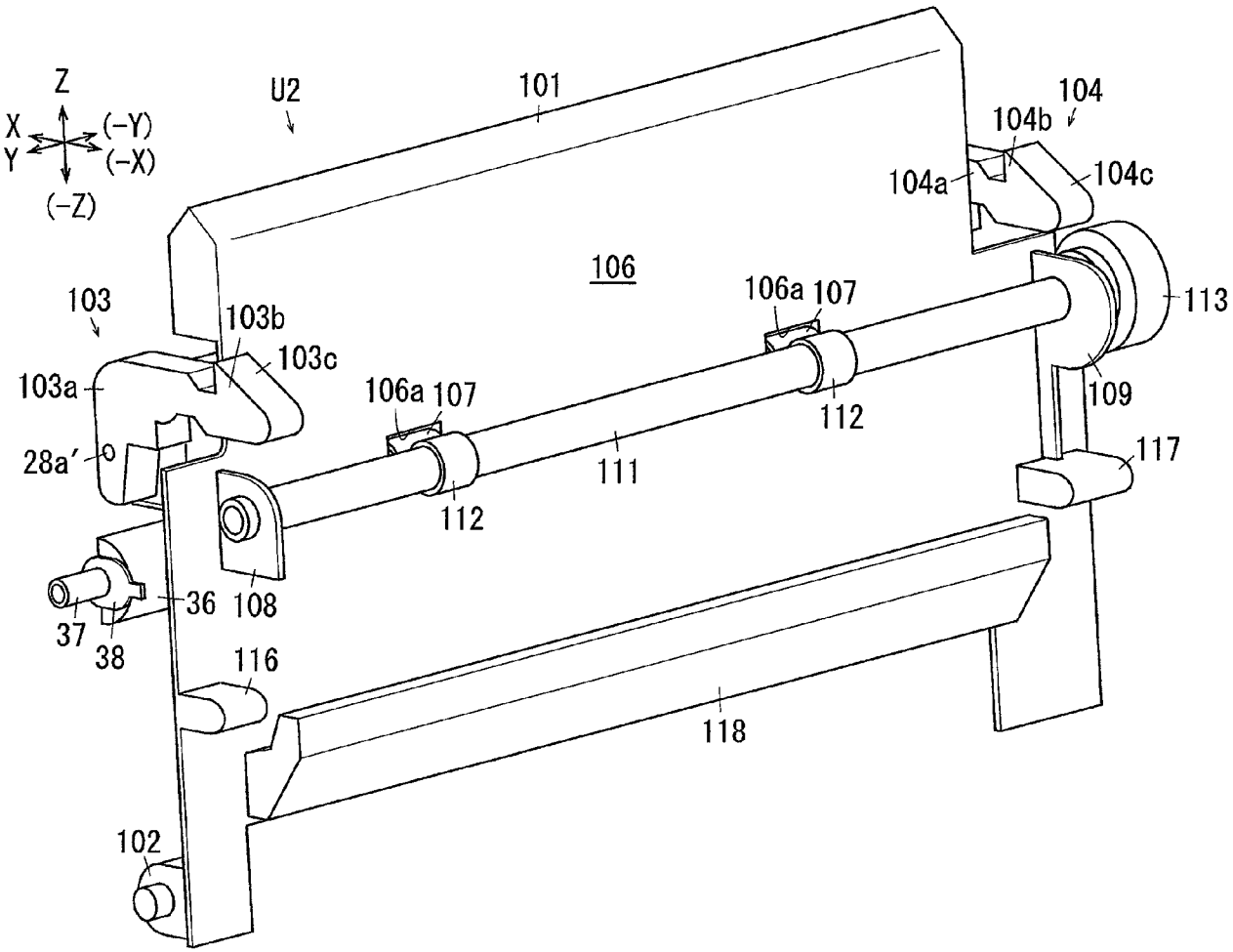
FIG. 12 is a perspective view in which the inside cover according to the third exemplary embodiment is viewed from its rear side.

FIG. 12 is a perspective view in which the inside cover according to the third exemplary embodiment is viewed from its rear side.

In FIG. 10, a rear cover U1*b*' according to the third exemplary embodiment has an inside cover U2 and an outside cover U3.

In FIGS. 11 and 12, the inside cover U2 has an inside cover body 101 as an example of an inside body, which is shaped like a plate extending in the up/down direction. A pair of left and right inside shaft portions 102 supported rotatably on the printer body U1 are formed in a lower end of the inside cover body 101. In a front surface of the inside cover body 101, the lower holders 3 and 4 and the upper holders 6 and 7 are formed in the same manner as in the first exemplary embodiment. In addition, the transfer slider 21 formed in the same manner as in the first exemplary embodiment is supported movably in the up/down direction on the front surface of the inside cover body 101.

In the transfer slider 21 according to the third exemplary embodiment, the lock interlocking protrusions 28 and 29 according to the first exemplary embodiment are replaced by interlocking support protrusions 28' and 29' formed in the same manner as the lock interlocking protrusions 28 and 29. Each interlocking support protrusion 28', 29' is an example of an interlocking support member. According to the third exemplary embodiment, the lock members 46 and 47 according to the first exemplary embodiment are replaced by inside interlocking hooks 103 and 104 fixedly supported on the interlocking support protrusions 28' and 29'. Each inside interlocking hook 103, 104 is an example of an inside interlocking member. Each inside interlocking hook 103, 104 includes an inside hook body 103*a*, 104*a* and an inside claw portion 103*b*, 104*b*. The inside hook body 103*a*, 104*a* extends upward from the interlocking support protrusions 28', 29' and then extends backward. The inside claw portion 103*b*, 104*b* protrudes upward from a rear end of the inside hook body 103*a*, 104*a*. In an upper surface of the inside claw portion 103*b*, 104*b*, an inside guide face 103*c*, 104*c* is formed to be inclined downward toward the rear.

In FIG. 12, a front inversion guide face 106 forming a front guide face of the inversion path SH2 is formed in a rear surface of the inside cover U2. A pair of left and right openings 106*a* are formed in the vertically central portion of the inversion guide face 106, and an inversion driven roller 107 as an example of an inversion driven member is supported rotatably in each opening 106*a*.

Shaft support flanges 108 and 109 protruding backward are supported on opposite (right and left) end portions of a rear surface of the inside cover U2. Each shaft support flange 108, 109 is an example of a shaft support portion. An inversion driving shaft 111 extending in the left/right direction is supported rotatably between the shaft support flanges 108 and 109. An inversion driving roller 112 as an example of an inversion driving member is supported on the inversion driving shaft 111 and disposed in opposition to each inversion driven roller 107 and in contact therewith. An inversion driving gear 113 for transmitting a driving force to the inversion driving shaft 111 is supported on a left surface of the left shaft support flange 109. The inversion driving gear 113 is an example of a driving force transmitting member. A driving force is transmitted from a not-shown driving source of the printer body U1 to the inversion driving gear 113.

Thus, a conveyance roller 107+112 for the inversion path according to the third exemplary embodiment is constituted by the inversion driven roller 107 and the inversion driving roller 112. The sheet S conveyed to the inversion path SH2 is conveyed toward the registration rolls Rr by the conveyance roller 107+112.

Under the shaft support flanges 108 and 109, erect protrusions 116 and 117 are formed to protrude backward. Each erect protrusion 116, 117 is an example of an erect contact member.

In FIGS. 10 to 12, under the erect protrusions 116 and 117, a lower end guide 118 as an example of a lower end guide member for guiding the sheet S conveyed through the inversion path SH2 is formed in the inside cover body 101. The lower end guide 118 extends in the left/right direction and curves to round the lower end of the inside cover body 101 from its rear surface toward its front surface.

In addition, a most downstream guide 119 as an example of a guide member of a downstream end of the inversion path SH2 is formed in the front surface lower portion of the inside cover body 101 so as to be opposed to the upper side of the lower end guide 118.

Figure 13:
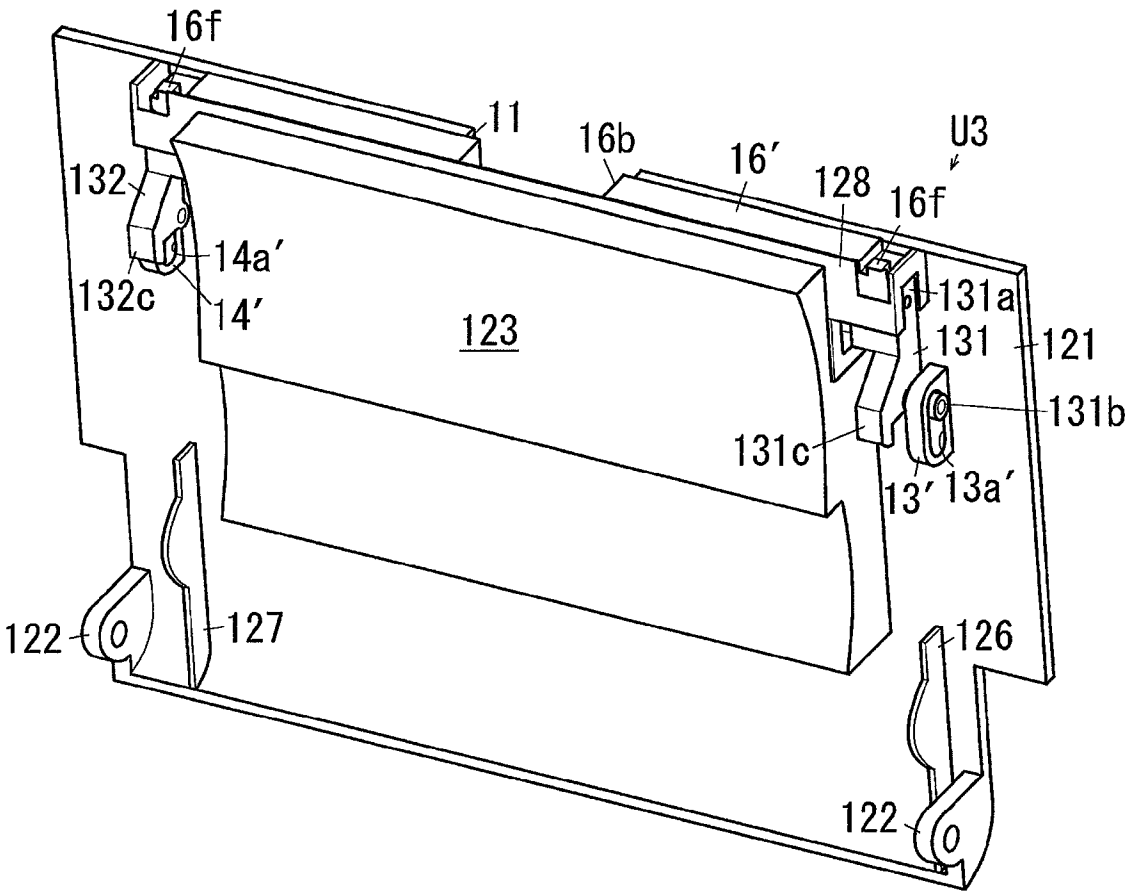
FIG. 13 is a perspective view of an outside cover according to the third exemplary embodiment.

FIG. 13 is a perspective view of the outside cover according to the third exemplary embodiment.

Figure 14:
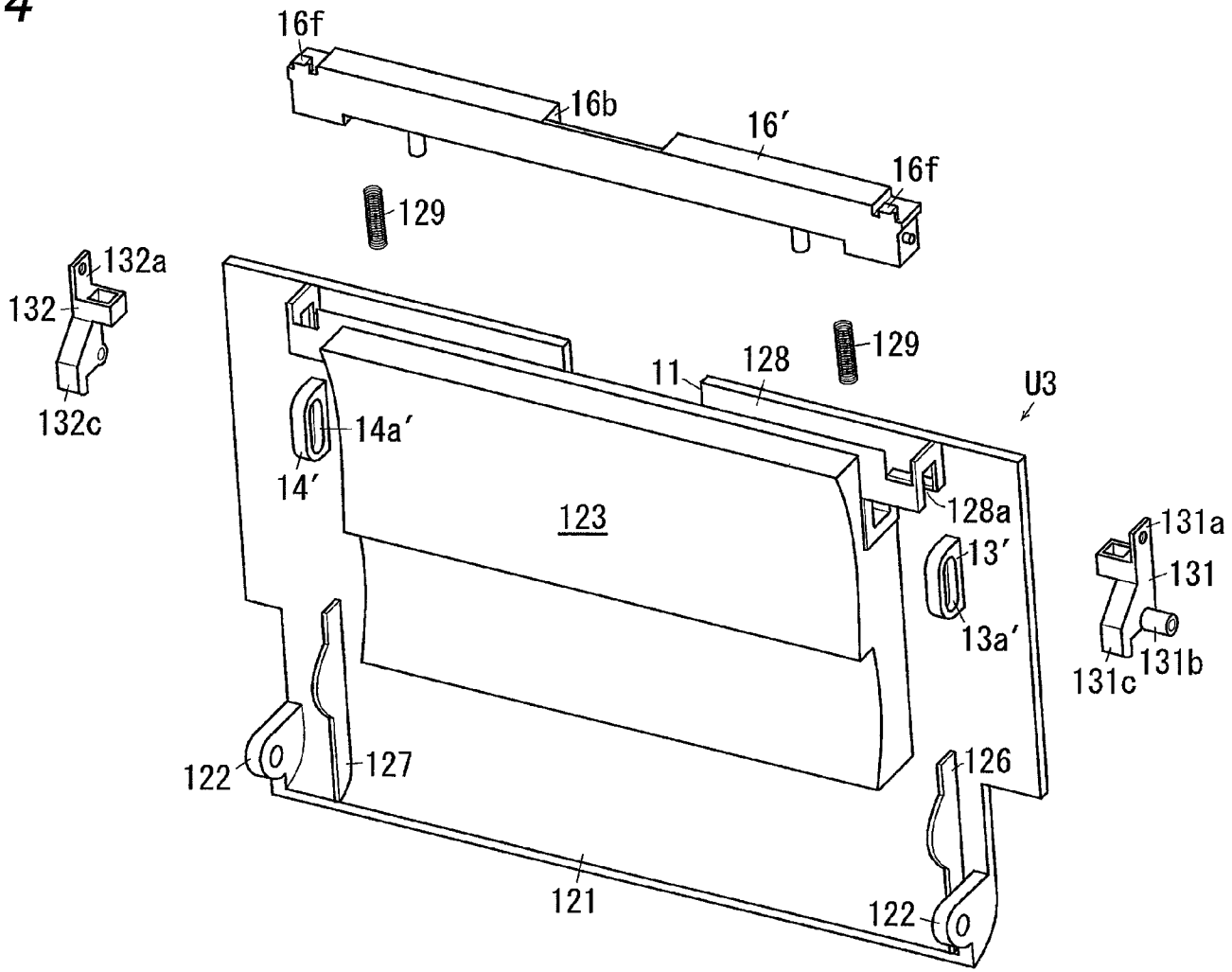
FIG. 14 is an exploded view for explaining the outside cover according to the third exemplary embodiment.

FIG. 14 is an exploded view for explaining the outside cover according to the third exemplary embodiment.

In FIGS. 10, 13 and 14, the outside cover U3 according to the third exemplary embodiment has an outside cover body 121 as an example of an outside body, which is shaped like a plate extending in the up/down direction. A pair of left and right outside shaft portion 122 supported rotatably on the printer body U1 are formed in the lower end of the outside cover body 121.

In FIGS. 13 and 14, an operating opening 11 similar to the operating opening 11 of the rear cover U1*b* according to the first exemplary embodiment is formed in the outside cover U3 according to the third exemplary embodiment.

In FIGS. 13 and 14, a rear inversion guide face 123 disposed in opposition to the front inversion guide face 106 and forming a rear guide face of the inversion path SH2 is formed in the front surface of the outside cover body 121. The inversion path SH2 according to the third exemplary embodiment is formed by a space between the inversion guide faces 106 and 123.

On the opposite right and left sides under the inversion guide face 123, erect guides 126 and 127 are formed to protrude frontally so that the erect protrusions 116 and 117 can touch the erect guides 126 and 127. Each erect guide 126, 127 is an example of an erect portion to be touched. Each erect guide 126, 127 is formed into a shape whose vertically central portion swells to be convex frontally.

In the upper end portion of the outside cover body 121, a concave handle receiving portion 128 as an example of an operating receiving portion is formed behind the inversion guide face 123. As shown in FIG. 14, open portions 128*a* opened in the upper, lower, left and right directions are formed in the opposite left and right ends of the handle receiving portion 128 according to the third exemplary embodiment.

A prismatic handle 16' extending in the left/right direction is received in the handle receiving portion 128 movably in the up/down direction. The handle 16' is an example of an operating portion. That is, the handle 16' is formed with a vertical length shorter than the vertical depth of the handle receiving portion 128. In FIGS. 13 and 14, an operating recess portion 16*b* similar to that of the handle 16 according to the first exemplary embodiment is formed in the handle 16' according to the third exemplary embodiment. In addition, a pair of left and right lock protrusions 16*f* protruding upward are formed in the opposite left and right end portions of the handle 16'. Each lock protrusion 16*f* is an example of a fixed portion. The lock protrusions 16*f* are designed to be able to be fitted into not-shown recesses formed in an upper exterior member of the printer body U1. When the lock protrusions 16*f* are fitted, the outside cover U3 can be retained in the closing position with respect to the printer body U1. In FIG. 14, coil springs 129 for urging the handle 16' upward are disposed between the lower surface of the handle 16' according to the third exemplary embodiment and the handle receiving portion 128. Each coil spring 129 is an example of an operating urging member.

On the opposite right and left sides of the inversion guide face 123 of the outside cover body 121, hook holding ribs 13' and 14' arranged in the same manner as the handle holding ribs 13 and 14 according to the first exemplary embodiment are formed under the open portions 128*a*. Each hook holding rib 13', 14' is an example of an interlocking holding portion. A hook lateral guide 13*a*', 14*a*' shaped like a long hole extending in the up/down direction and arranged in the same manner as the handle lateral guide 13*a*, 14*a* according to the first exemplary embodiment is formed in the hook holding rib 13', 14'.

In FIGS. 13 and 14, outside interlocking hooks 131 and 132 are supported on the hook lateral guides 13*a*' and 14*a*'. Each outside interlocking hook 131, 132 is an example of an outside interlocking member. Handle fixing portions 131*a* and 132*a* are formed in upper end portions of the outside interlocking hooks 131 and 132. Each handle fixing portion 131*a*, 132*a* is an example of a coupling portion. The handle fixing portions 131*a* and 132*a* are put into the open portions 128*a* and screwed to the opposite right and left end portions of the handle 16'.

Guided protrusions 131*b* and 132*b* are formed in the lower portions of the handle fixing portions 131*a* and 132*a*. Each guided protrusion 131*b*, 132*b* is an example of a guided portion. The guided protrusions 131*b* and 132*b* are fitted to and supported on the hook lateral guides 13*a*' and 14*a*' movably in the up/down direction. Thus, according to the third exemplary embodiment, the handle 16' is supported movably in the up/down direction along the hook lateral guides 13*a*' and 14*a*' by the guided protrusions 131*b* and 132*b* of the outside interlocking hooks 131 and 132 which are fixed and coupled with the handle 16'.

In the front end portions of the outside interlocking hooks 131 and 132, outside claw portions 131*c* and 132*c* protruding downward are formed correspondingly to the inside interlocking hooks 103 and 104.

A rear cover U1*b*' as an openable member according to the third exemplary embodiment is constituted by the inside cover U2 and the outside cover U3.

Operation of Third Exemplary Embodiment

Figure 15:
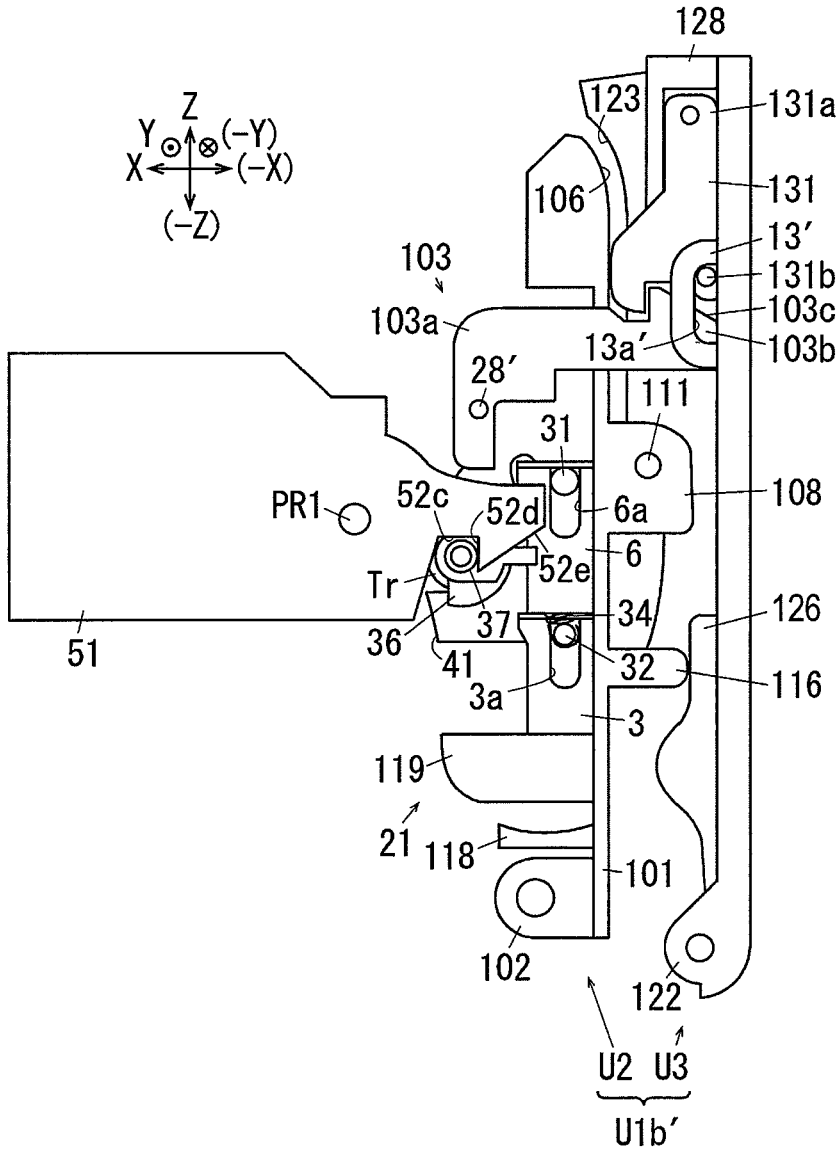
FIG. 15 is a view for explaining opening/closing of the rear cover according to the third exemplary embodiment, in which view the rear cover has moved to a closing position and which view corresponds to FIG. 7 of the first exemplary embodiment.

FIG. 15 is a view for explaining opening/closing of the rear cover according to the third exemplary embodiment, in which view the rear cover has moved to the closing position and which view corresponds to FIG. 7 of the first exemplary embodiment.

Figure 16:
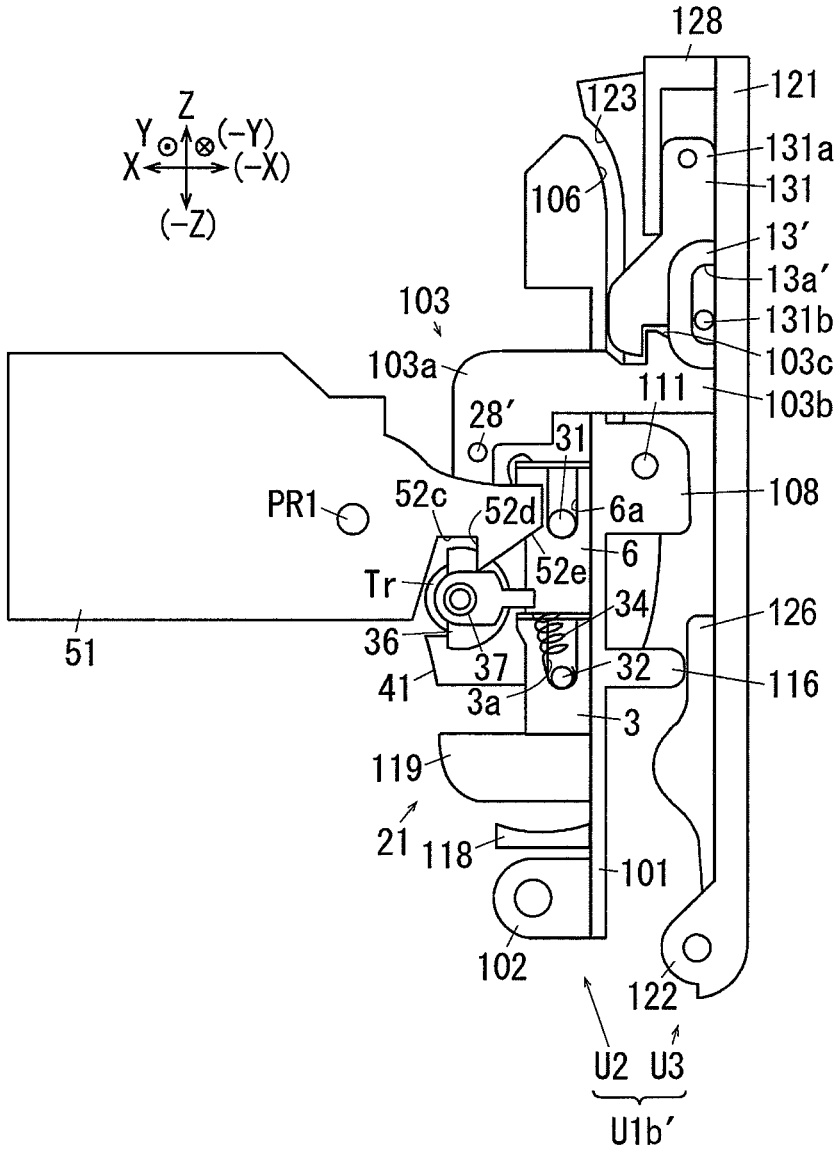
FIG. 16 is a view for explaining opening/closing of the rear cover according to the third exemplary embodiment, in which view a handle has been pushed and which view corresponds to FIG. 8 of the first exemplary embodiment.

FIG. 16 is a view for explaining opening/closing of the rear cover according to the third exemplary embodiment, in which view the handle has been pushed and which view corresponds to FIG. 8 of the first exemplary embodiment.

Figure 17:
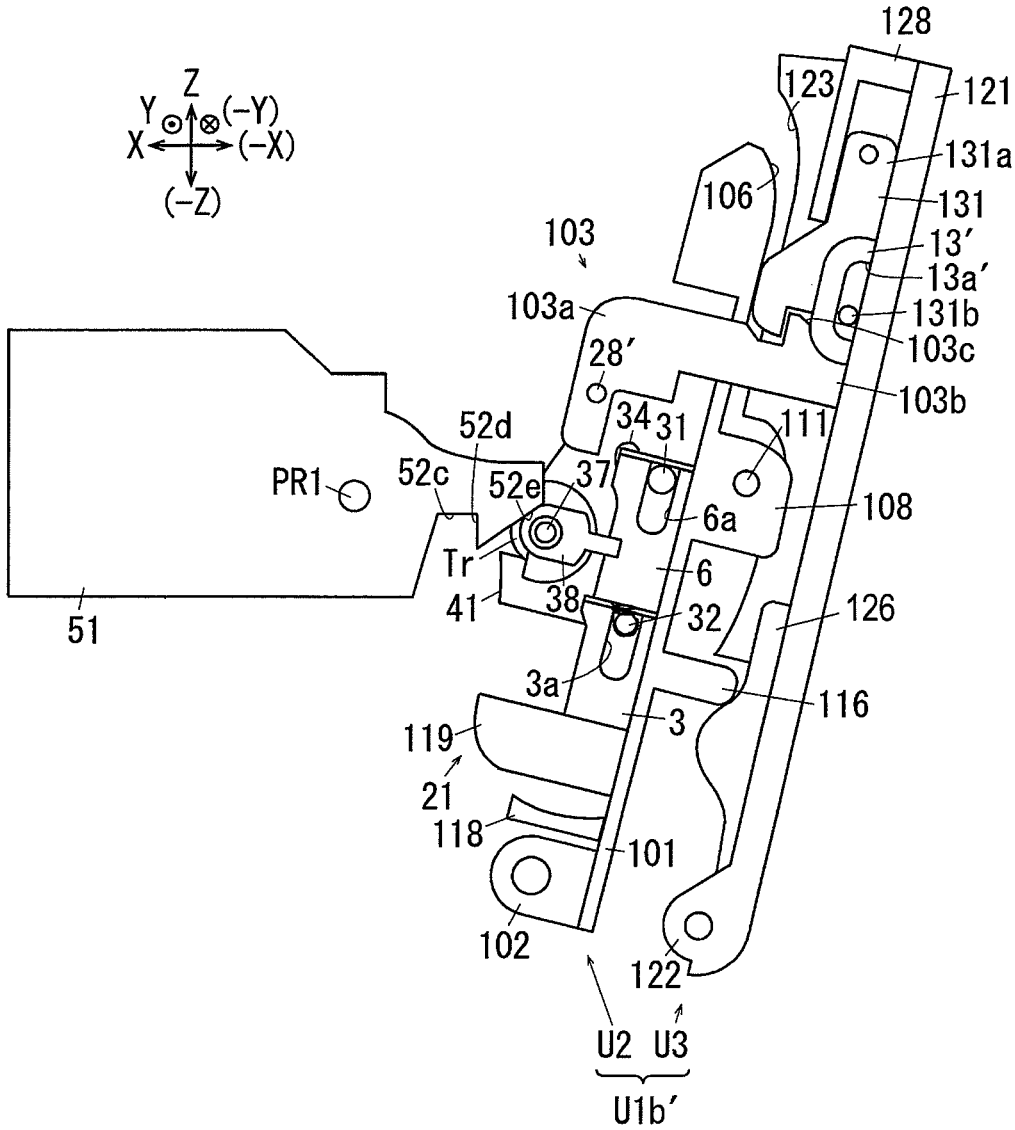
FIG. 17 is a view for explaining the state where the rear cover has been rotated toward an opening position in the state shown in FIG. 16.

FIG. 17 is a view for explaining the state where the rear cover has been rotated toward the opening position in the state shown in FIG. 16.

Figure 18:
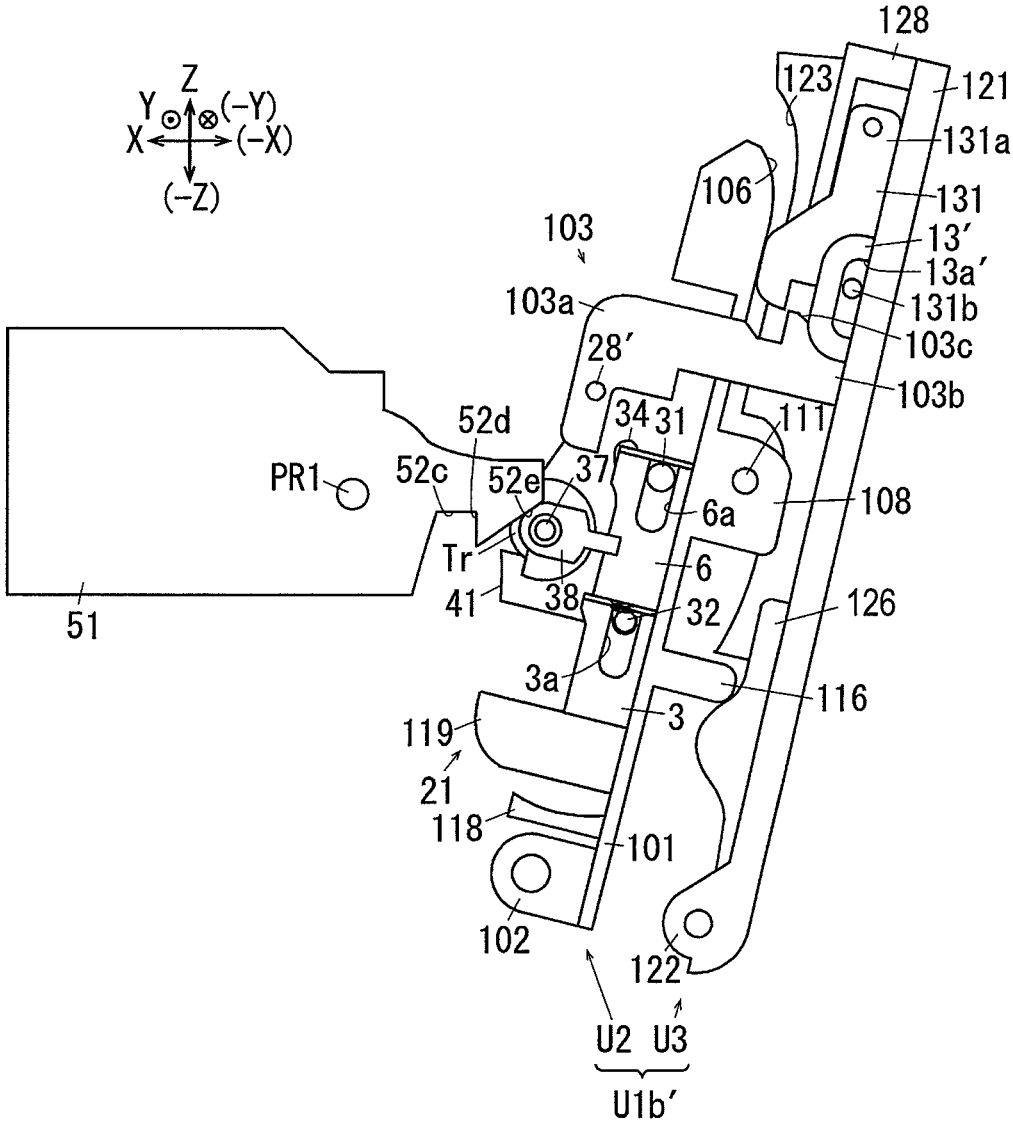
FIG. 18 is a view for explaining the state where the handle has moved toward a contactable position in the state shown in FIG. 17.

FIG. 18 is a view for explaining the state where the handle has moved toward a contactable position in the state shown in FIG. 17.

Figure 19:
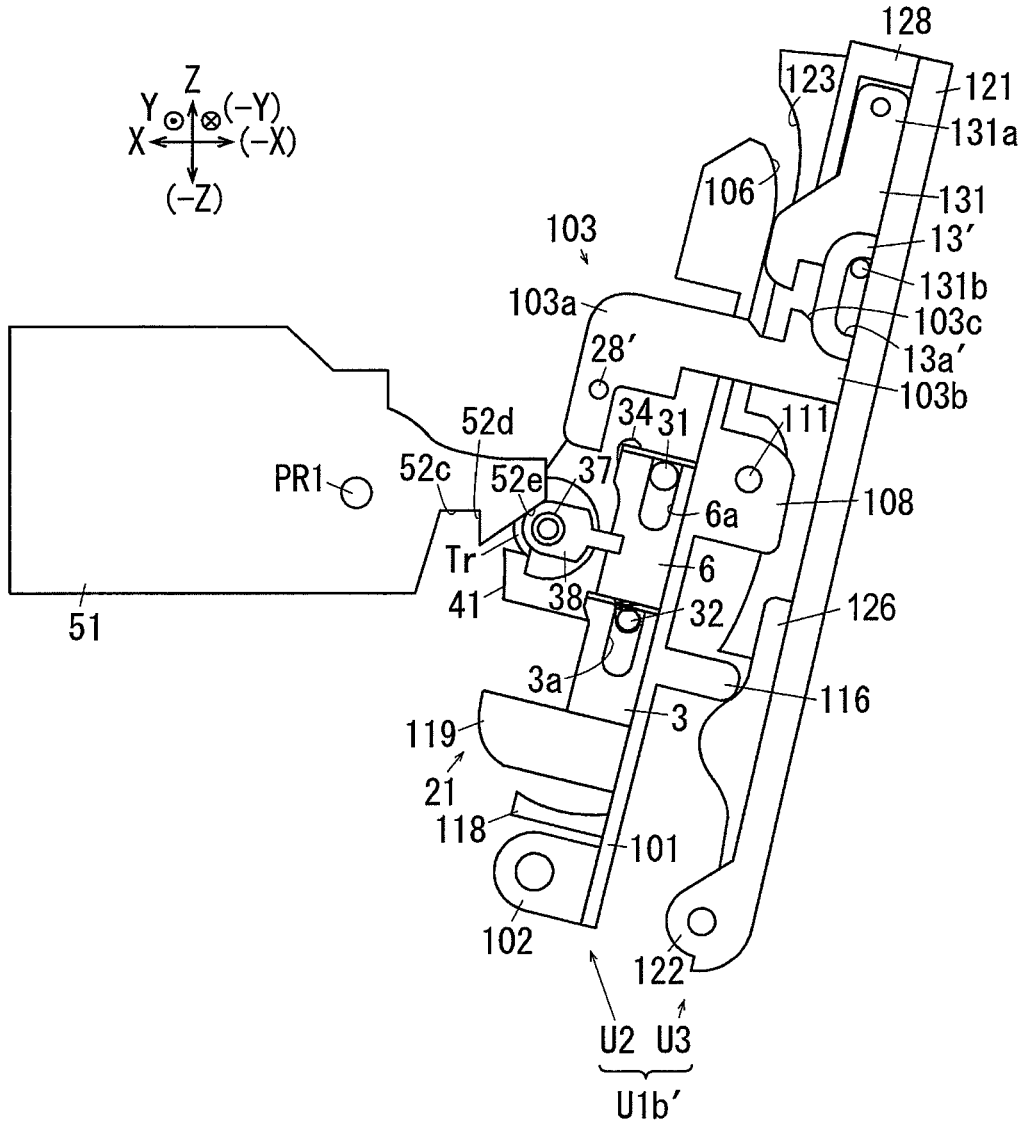
FIG. 19 is a view for explaining the state where the handle has moved further toward the contactable position in the state shown in FIG. 18.

FIG. 19 is a view for explaining the state where the handle has moved further toward the contactable position in the state shown in FIG. 18.

Figure 20:
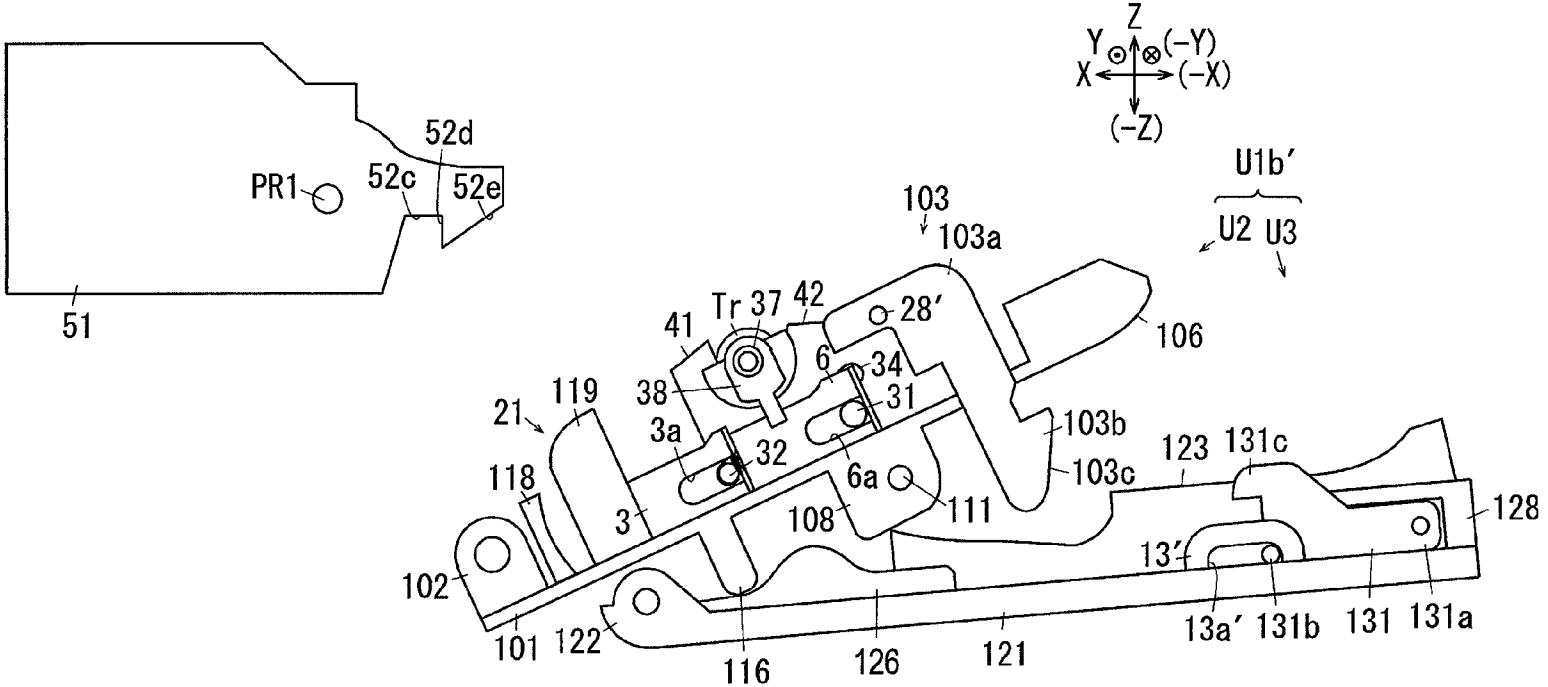
FIG. 20 is a view for explaining the state where the rear cover has moved to the opening position.

FIG. 20 is a view for explaining the state where the rear cover has moved to the opening position.

In the printer U configured thus according to the third exemplary embodiment, when the operator pushes down the operating recess portion 16*b* of the handle 16' against the coil springs 129 in order to reveal the inside of the printer U to solve a paper jam or the like occurring in the sheet conveyance path SH or the inversion path SH2, the handle 16' moves down from the contactable position shown in FIG. 15 toward the releasable position shown in FIG. 16. When the handle 16' moves down, the lock protrusions 16*f* are released from locking with not-shown recesses so that the outside cover U3 can rotate while the outside interlocking hooks 131 and 132 move down integrally to push down the inside interlocking hooks 103 and 104 engaging with the outside interlocking hooks 131 and 132. Accordingly, the transfer slider 21 moves from the positioning position shown in FIG. 15 toward the leaving position shown in FIG. 16 against the elastic force of the coil springs 34. As a result, the rotation shaft 37 as an example of a fixed portion according to the third exemplary embodiment moves down to leave the transfer positioning portion 52 as an example of an opening/closing fixing portion according to the third exemplary embodiment. Thus, the inside cover U2 is released from lock for holding the inside cover U2 in the closing position shown in FIGS. 15 and 16.

In FIGS. 16 and 17, when the outside cover U3 is rotated toward the opening position in the unlocked state of the inside cover U2, the inside cover U2 also begins to rotate integrally toward the opening position due to the engagement of the interlocking hooks 103, 104, 131 and 132.

As shown in FIG. 17, when the handle 16' is released from being pushed down in the state where the rotation shaft 37 has moved outside the transfer positioning portion 52, the handle 16' and the transfer slider 21 move toward the contactable position and the positioning position due to the elastic restoring force of the coil springs 34 and 129 respectively. On this occasion, as shown in FIGS. 17 to 19, the inside interlocking hooks 103 and 104 and the outside interlocking hooks 131 and 132 are disengaged from each other in accordance with the misalignment between the inside shaft portion 102 of the inside cover U2 and the outside shaft portion 122 of the outside cover U3. Thus, the inside cover U2 and the outside cover U3 are made rotatable around the shaft portions 102 and 122 respectively, independently of each other.

Thus, also according to the third exemplary embodiment, when the rear cover U1*b*' moves toward the opening position, the transfer roll Tr once moves down in a moving direction crossing the opening/closing direction of the rear cover U1*b* and then returns upward.

When the outside cover U3 is rotated toward the opening position in the state shown in FIG. 19, the inside cover U2 rotates toward the opening position together with the outside cover U3 due to the own weight of the inside cover U2 and the contact between each erect protrusion 116, 117 of the inside cover U2 and each erect guide 126, 127 of the outside cover U3.

In FIG. 20, when each cover U2, U3 moves to the opening position shown in FIG. 20, the outer surface of the outside cover U3 is put along the horizontal plane, while the inside cover U2 is retained at a distance from the outside cover U3 due to the contact between each erect protrusion 116, 117 and each erect guide 126, 127. As a result, a gap is produced between the inside cover U2 and the outside cover U3 so that the operator can put his/her hand into the gap easily. Thus, only the inside cover U2 can be grasped and rotated easily in comparison with the configuration where no gap is produced between the covers U2 and U3.

Thus, the sheet conveyance path SH is opened in the state shown in FIG. 20 so that the sheet S jammed in the sheet conveyance path SH can be removed, or parts inside the printer body U1 can be replaced.

In order to remove the sheet S jammed in the inversion path SH2, the inversion path SH2 can be opened if only the inside cover U2 is grasped and moved toward the closing position.

On this occasion, when only the inside cover U2 is moved toward the closing position, in the same manner as in the first exemplary embodiment the transfer slider 21 once moves down toward the leaving position due to the contact between the transfer guide face 52*e* of the transfer positioning portion 52 and the rotation shaft 37 of the transfer roll Tr. The transfer slider 21 can be then retained in the positioning position due to the elastic force of the coil springs 34. That is, removal of the sheet S or the like can be carried out easily in the state where the inside cover U2 has been retained in the closing position shown in FIG. 15, the outside cover U3 has moved to the opening position shown in FIG. 20, and the inversion path SH2 has been kept open.

Assume that the outside cover U3 is returned to the closing position in the state where the inversion path SH2 has been opened. In this case, when the outside interlocking hooks 131 and 132 of the outside cover U3 come into contact with the inside guide faces 103*c* and 104*c* of the inside interlocking hooks 103 and 104 of the inside cover U2. Thus, the transfer slider 21 once moves down toward the leaving position. Then, the transfer slider 21 returns to the positioning position due to the elastic force of the coil springs 34. The outside interlocking hooks 131 and 132 engage with the inside interlocking hooks 103 and 104 so as to retain the outside cover U3 on the inside cover U2. As a result, the rear cover U1*b*' moves to the closing position.

In order to move the rear cover U1*b*' to the closing position in the state shown in FIG. 20, the outside cover U3 is operated to rotate toward the closing position. Due to contact between each erect protrusion 116, 117 and each erect guide 126, 127, the inside cover U2 rotates toward the closing position together with the outside cover U3. Thus the inside cover U2 is retained in the closing position due to engagement of the interlocking hooks 103 and 104 with the interlocking hooks 131 and 132 and engagement of the transfer positioning portion 52 with the rotation shaft 37 of the transfer roll Tr.

When the rear cover U1*b*' has moved to the closing position, similar operation to that of the first exemplary embodiment is provided due to the rotation shaft 37 of the transfer roll Tr positioned by the transfer positioning portion 52 in the same manner as in the first exemplary embodiment. That is, also according to the third exemplary embodiment, when the rear cover U1*b*' moves toward the closing position, the transfer roll Tr once moves downward in the moving direction crossing the opening/closing direction of the rear cover U1*b*' and then moves back upward.

(Modifications)

The exemplary embodiments of the invention have been described above in detail. However, the invention is not limited to the exemplary embodiments, but various changes can be made within the gist of the invention stated in the scope of claims. Modifications (H01) to (H07) of the invention will be shown below.

(H01) In the aforementioned exemplary embodiments, a printer was shown as an example of an image forming apparatus. The invention is not limited to the printer but can be also applied to a copying machine, a fax machine, a composite machine having a plurality or all of functions of those, or the like.

(H02) In the aforementioned exemplary embodiments, the printer U was designed to use a monochromatic developer by way of example. The invention is not limited to such a configuration, but can be also applied to a multi-color image forming apparatus for two or more colors.

(H03) In the aforementioned exemplary embodiments, the shape of the transfer positioning portion 52 is not limited to the illustrated shape, but can be formed into any shape. The upper positioning portion 52*a* passing above the transfer roll Tr may be changes suitably in accordance with design. For example, the configuration of the upper positioning portion 52*a* may be replaced by a configuration where the upper positioning portion 52*a* passes below the transfer roll Tr. Accordingly, the moving direction of the transfer slider 21 is not limited to the configuration where the transfer slider 21 once moves downward with respective to the transfer positioning portion 52 and then moves upward when the cover is opened or closed. The transfer slider 21 may be designed to once move upward and then move downward.

(H04) In the aforementioned exemplary embodiments, it is desired to form the transfer positioning portion 52 integrally with the process frame 51. The invention is not limited to such a configuration, but can have any configuration where the transfer positioning portion 52 is fixedly supported on the image forming apparatus body.

(H05) In the aforementioned exemplary embodiments, the configuration by which the photoconductor PR and the transfer roll Tr are positioned was illustrated by way of example. The invention is not limited to the configuration. For example, the invention can be applied to the configuration where a driving roller supported on the image forming apparatus body and a driven roller supported on the cover are positioned. In addition, the configuration by which the drum-like photoconductor PR as an example of an image retainer and the transfer roll Tr are positioned was illustrated by way of example. The invention is not limited to the configuration, but can be applied to the configuration by which an endless belt-like image retainer and a roller are positioned. For example, the invention can be applied to a multi-color image forming apparatus in which an intermediate transfer belt as an example of an image retainer and a secondary transfer roll as an example of a transfer member are positioned.

(H06) In the aforementioned exemplary embodiments, the configuration where positioning is performed in two places, that is, in the upper positioning face 52*c* and the rear positioning face 52*d* was illustrated by way of example. Although it is desired to use the configuration where positioning is performed in two or more places, positioning may be performed in only one place. For example, it is possible to use the configuration where the upper positioning face 52*c* is not brought into contact with the rotation shaft 37 of the transfer roll Tr but only the rear positioning face 52*d* is brought into contact therewith.

(H07) In the aforementioned exemplary embodiments, the configuration where the rear positioning face 52*d* is formed along the up/down direction was illustrated by way of example. The invention is not limited to the configuration. The rear positioning face 52*d* may be formed in any direction. It is, however, desired that the rear position face 52*d* is formed in a direction perpendicular to the line connecting the photoconductor PR and the center of the transfer roll.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming apparatus body;

an openable member that is supported movably between an opening position where the openable member is opened to reveal an inside of the image forming apparatus body and a closing position where the openable member is closed to hide the inside of the image forming apparatus body;

a positioning portion that is provided in the image forming apparatus body;

a positioned portion that is supported on the openable member and that is brought into contact with the positioning portion to be positioned when the openable member is in the closing position;

a rotary member that is supported on the image forming apparatus body; and an opposed member that is supported on the openable member, wherein, when the openable member moves to the closing position, the opposed member moves in a moving direction crossing an opening/closing direction of the openable member, and the opposed member is opposed to the rotary member rotatably when the openable member is in the closing position, a first urging member that is supported by the openable member; and a movable piece that supports the positioned portion and the opposed member and that is supported movably relatively to the openable member, wherein the first urging member urges the opposed member toward an image retainer when the openable member is in the closing position, and wherein the first urging member urges the movable piece in a direction moving away from a pivot axis of the openable member.

2. The image forming apparatus according to claim 1, wherein the rotary member includes the image retainer which retains an image on a surface thereof, and the opposed member includes a transfer member which comes in contact with the image retainer to rotate and transfer the image on the surface of the image retainer to a medium.

3. The image forming apparatus according to claim 2, further comprising:

a second urging member that urges the opposed member toward the image retainer, wherein the positioned portion includes an urging support which supports the opposed member movably to touch and leave the rotary member and which supports the urging member.

4. The image forming apparatus according to claim 1, wherein the positioned portion includes a rotary shaft of the opposed member.

5. The image forming apparatus according to claim 4, wherein the positioning portion positions the positioned portion by contact with the positioned portion on an opposite side to the rotary member with respect to the opposed member in a direction where the rotary member and the opposed member are opposed to each other.

6. The image forming apparatus according to claim 1, wherein the positioning portion is provided on a frame which supports the rotary member.

7. The image forming apparatus according to claim 1, further comprising:

an opening/closing fixing portion that is provided in the image forming apparatus body;

a fixed portion that is provided in the openable member and that is configured to touch and leave the opening/closing fixing portion;

an operating position that is provided in the openable member and that is configured to be operated by an operator between a releasable position where the operating portion can release the fixed portion and the opening/closing fixing portion from contact with each other and a contactable position where the operating portion can bring the fixed portion and the opening/closing fixing portion into contact with each other, wherein the movable piece moves between a positioning position and a leaving position in connection with the operating portion moving between the contactable position and the releasable position, the positioned portion is brought into contact with the positioning portion to be positioned when the movable piece moves to the positioning position, and the positioned portion leaves the positioning portion when the movable piece moves to the leaving position.

* * * * *